US010958002B2

(12) United States Patent
Copper et al.

(10) Patent No.: US 10,958,002 B2
(45) Date of Patent: Mar. 23, 2021

(54) ELECTRICAL POWER CONNECTOR CONFIGURED FOR HIGH CURRENT DENSITY

(71) Applicant: FCI USA LLC, Etters, PA (US)

(72) Inventors: Charles Copper, Hummelstown, PA (US); Christopher J. Kolivoski, Lewisberry, PA (US); Hung Viet Ngo, Austin, TX (US); Thomas A. Brungard, York, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 16/745,235

(22) Filed: Jan. 16, 2020

(65) Prior Publication Data

US 2020/0153136 A1 May 14, 2020

Related U.S. Application Data

(63) Continuation of application No. 15/758,144, filed as application No. PCT/US2016/050813 on Sep. 8, 2016, now Pat. No. 10,553,973.

(Continued)

(51) Int. Cl.

| | |
|---|---|
| ***H01R 12/72*** | (2011.01) |
| ***H01R 12/70*** | (2011.01) |
| ***H01R 13/02*** | (2006.01) |

(52) U.S. Cl.

CPC ..... *H01R 12/724* (2013.01); *H01R 12/7088* (2013.01); *H01R 12/721* (2013.01); *H01R 13/02* (2013.01)

(58) Field of Classification Search

CPC ..... H01R 23/7073; H01R 23/6873; H01R 12/7011; H01R 12/724; H01R 12/73; H01R 12/585

(Continued)

(56) References Cited

U.S. PATENT DOCUMENTS 3,075,167 A * 1/1963 Kinkaid ..... H01R 12/721 439/636
3,720,907 A * 3/1973 Asick ..... H01R 13/428 439/636

(Continued)

FOREIGN PATENT DOCUMENTS

CN 2687869 Y 3/2005
CN 2924830 Y 7/2007

(Continued)

OTHER PUBLICATIONS

Chinese Office Action for Chinese Application No. 201680060943.0 dated Mar. 29, 2019.

(Continued)

*Primary Examiner* — Abdullah A Riyami
*Assistant Examiner* — Marcus E Harcum
(74) *Attorney, Agent, or Firm* — Wolf, Greenfield & Sacks, P.C.

(57) ABSTRACT

An electrical power interconnection system is described. The electrical interconnection system may comprise an electrical power connector and a substrate, such as a printed circuit board. The electrical power connector may comprise a housing and a plurality of electrical power contacts supported by the housing. The electrical power contacts may comprise a mounting end, a mating end, and a contact body disposed between the mounting end and the mating end. The electrical power contacts may have planar portions. The mating ends may comprise opposing first second beams defining a slot. The slot may be configured to receive the substrate therein, such that the first beam contacts the first side of the substrate and the second beam contacts the second side of the substrate.

25 Claims, 16 Drawing Sheets

Related U.S. Application Data

(60) Provisional application No. 62/215,995, filed on Sep. 9, 2015, provisional application No. 62/215,588, filed on Sep. 8, 2015.

(58) Field of Classification Search
USPC ..... 439/494, 636, 637, 607.31–33
See application file for complete search history.

(56) References Cited

U.S. PATENT DOCUMENTS

| | | | | |
|---|---|---|---|---|
| 4,275,944 | A * | 6/1981 | Sochor | H01R 12/89 439/267 |
| 4,804,334 | A * | 2/1989 | Alexeenko | H01R 12/88 439/260 |
| 5,366,390 | A * | 11/1994 | Kinross | H01R 12/83 439/326 |
| 5,522,733 | A | 6/1996 | White et al. | |
| 5,562,497 | A | 10/1996 | Yagi et al. | |
| 5,695,354 | A | 12/1997 | Noda | |
| 5,713,764 | A * | 2/1998 | Brunker | H01R 12/83 439/630 |
| 7,275,966 | B2 * | 10/2007 | Poh | H01R 13/533 439/485 |
| 7,303,401 | B2 | 12/2007 | Schell et al. | |
| 7,354,300 | B2 | 4/2008 | Shindo | |
| 7,361,042 | B2 | 4/2008 | Hashimoto et al. | |
| 7,722,404 | B2 | 5/2010 | Neumetzler | |
| 7,828,560 | B2 | 11/2010 | Wu et al. | |
| 7,914,302 | B1 | 3/2011 | Zhu | |
| 8,043,097 | B2 | 10/2011 | Ngo et al. | |
| 8,057,266 | B1 | 11/2011 | Roitberg | |
| 8,092,254 | B2 | 1/2012 | Miyazaki et al. | |
| 8,109,789 | B2 | 2/2012 | Tyler | |
| 8,282,402 | B2 | 10/2012 | Ngo | |
| 8,632,365 | B2 | 1/2014 | Ngo | |
| 8,651,880 | B2 | 2/2014 | Wu et al. | |
| 9,300,067 | B2 | 3/2016 | Yokoo | |
| 9,685,724 | B2 | 6/2017 | Tojo | |
| 10,128,624 | B2 | 11/2018 | Tyler et al. | |
| 10,141,669 | B2 | 11/2018 | Tyler et al. | |
| 10,148,041 | B2 | 12/2018 | Lyon et al. | |
| 10,553,973 | B2 | 2/2020 | Copper et al. | |
| 2002/0192989 | A1 | 12/2002 | Ling et al. | |
| 2004/0224552 | A1 | 11/2004 | Hagmann et al. | |
| 2008/0096399 | A1 * | 4/2008 | Goh | H01R 12/721 439/55 |
| 2008/0214055 | A1 | 9/2008 | Gulla | |
| 2009/0170367 | A1 | 7/2009 | Hemmi et al. | |
| 2009/0269971 | A1 | 10/2009 | Tamura et al. | |
| 2009/0291596 | A1 | 11/2009 | Miyazoe | |
| 2011/0300760 | A1 | 12/2011 | Ngo | |
| 2012/0252232 | A1 | 10/2012 | Buck et al. | |
| 2013/0040482 | A1 | 2/2013 | Ngo et al. | |
| 2014/0057475 | A1 | 2/2014 | Tohjo | |
| 2014/0295680 | A1 | 10/2014 | YuQiang et al. | |
| 2015/0357747 | A1 | 12/2015 | Filipon et al. | |
| 2018/0254573 | A1 | 9/2018 | Copper et al. | |

FOREIGN PATENT DOCUMENTS

| | | | |
|---|---|---|---|
| CN | 101032056 | A | 9/2007 |
| CN | 101132087 | A | 2/2008 |
| CN | 201048223 | Y | 4/2008 |
| CN | 202840016 | U | 3/2013 |
| CN | 209266628 | U | 8/2019 |
| CN | 209266699 | U | 8/2019 |
| KR | 10-2013-0070005 | A | 6/2013 |

OTHER PUBLICATIONS

Chinese Office Action for Chinese Application No. 201680060943.0 dated Oct. 9, 2019.

International Search Report and Written Opinion for International Application No. PCT/US2016/050813 dated Dec. 14, 2016.

International Preliminary Report on Patentability for International Application No. PCT/US2016/050813 dated Mar. 22, 2018.

Chinese office action in connection with Chinese Application No. 201680060943.0 dated Mar. 12, 2020.

* cited by examiner

L
A
24
24a
24b 32
28
30
46a
46b
T
A

L
T
A
42
46a
46b
30
28
38
32

42
46a
46b
30
28
38
32

ELECTRICAL POWER CONNECTOR CONFIGURED FOR HIGH CURRENT DENSITY

RELATED APPLICATIONS

This application is a continuation of U.S. patent application Ser. No. 15/758,144, filed on Mar. 7, 2018, entitled "ELECTRICAL POWER CONNECTOR," which is a 35 U.S.C. § 371 National Phase filing of International Application No. PCT/US2016/050813, filed on Sep. 8, 2016, which claims priority to and the benefit under 35 USC § 119 to U.S. Provisional Patent Application Ser. No. 62/215,995, filed on Sep. 9, 2015, entitled "ELECTRICAL POWER CONNECTOR," as well as claims priority to and the benefit under 35 U.S.C. § 119 to U.S. Provisional Patent Application Ser. No. 62/215,588, filed on Sep. 8, 2015, entitled "ELECTRICAL POWER CONNECTOR." The entire contents of these applications are incorporated herein by reference in their entirety herein.

BACKGROUND

Electrical power connectors, such as those described in U.S. Pat. No. 8,043,097, are known. U.S. Pat. No. 8,043,097 is incorporated by reference as if set forth in its entirety herein.

SUMMARY

In accordance with one aspect of the present disclosure, an electrical power connector is described. The electrical power connector may comprise an electrically insulative connector housing that defines a mating interface, wherein the mating interface further defines a slot, the connector housing further defining a mounting interface; a plurality of electrical power contacts supported by the connector housing and spaced along a longitudinal direction, each of the electrical power contacts defining a mating end disposed proximate to the mating interface, a mounting end that is opposite the mating end and disposed proximate to the mounting interface, and a contact body that extends from the mating end to the mounting end, the plurality of electrical power contacts being planar and disposed perpendicularly with respect to the longitudinal direction; and wherein each of the mating ends includes a first beam that extends from the contact body and a second beam that extends from the contact body, the first beam and the second beam disposed at opposed sides of the slot with respect to a transverse direction that is perpendicular to the longitudinal direction, such that a first substrate is configured to be received between the first beams of the electrical power contacts and the second beams of the electrical power contacts along a lateral direction that is perpendicular to each of the transverse direction and the longitudinal direction.

In some embodiments, the plurality of electrical power contacts are spaced equidistantly along the longitudinal direction.

In some embodiments, when the substrate is received in the slot, the first beam is configured to form a first electrical contact with a first pad disposed on a first surface of the substrate.

In some embodiments, when the substrate is received in the slot, the second beam is configured to form a second electrical contact with a second pad disposed on a second surface, opposite the first surface, of the substrate.

In some embodiments, the mating interface and the mounting interface are perpendicular to each other.

In some embodiments, the plurality of electrical power contacts are spaced, along the longitudinal direction, by a distance that is between approximately 0.7 mm and approximately 2 mm.

In some embodiments, the first and second beams comprises a first edge and a second edge opposite the first edge, the first and second edges being configured, when the substrate is received in the slot, to contact respectively a first pad, disposed on a first surface of the substrate, and a second pad, disposed on a second surface of the substrate opposite the first surface.

In some embodiments, the electrical power contacts comprise a first group of electrical power contacts alternating, along the longitudinal direction, with a second group of electrical power contacts, and wherein the electrical power contacts of the first group have a different geometry with respect to the electrical power contacts of the second group.

In some embodiments, the mounting ends of the first group of electrical power contacts are offset with respect to the mounting ends of the second group of electrical power contacts along the lateral direction.

In some embodiments, each electrical power contact of the first group has a first number of mounting ends and each electrical power contact of the second group has a second number of mounting ends, wherein the first number is different from the second number.

In accordance with one aspect of the present disclosure, an electrical power connector is described. The electrical power connector may comprise an electrically insulative connector housing that defines a mating interface, wherein the mating interface further defines a slot, the connector housing further defining a mounting interface; a plurality of electrical power contacts supported by the connector housing and spaced along a longitudinal direction, each of the plurality of electrical power contacts defining a mating end disposed proximate to the mating interface, a mounting end that is opposite the mating end and disposed proximate to the mounting interface, and a contact body that extends from the mating end to the mounting end, each of the plurality of electrical power contacts having a portion that is planar and is disposed perpendicularly with respect to the longitudinal direction; wherein each of the mating ends includes a first beam that extends from the contact body and a second beam that extends from the contact body, the first beam and the second beam are disposed at opposed sides of the slot with respect to a transverse direction that is perpendicular to the longitudinal direction, such that a first substrate is configured to be received between the first and second beams along a lateral direction that is perpendicular to each of the transverse direction and the longitudinal direction, and wherein each of the first and second beams includes a first beam portion and a second beam portion, the first beam portion being disposed between the second beam portion and the contact body along the lateral direction, the second beam portion being wider than the first beam portion along the transverse direction.

In some embodiments, the first beam portion has a width that is between approximately 0.3 mm and approximately 0.7 mm.

In some embodiments, the first beam portion has a length that is between approximately 2 mm and approximately 4 mm.

In some embodiments, a ratio between a width of the first beam portion and a width of the second beam portion is between 0.3 and 0.45.

In some embodiments, a ratio between a length of the first beam portion and a length of the second beam portion is between 0.3 and 0.55.

In some embodiments, the electrical power contacts comprise a first group of electrical power contacts alternating, along the longitudinal direction, with a second group of electrical power contacts, and wherein the electrical power contacts of the first group have a different geometry with respect to the electrical power contacts of the second group.

In some embodiments, each of the electrical power contacts of the first group comprises a jogged portion such that the mounting end and the mating end are offset with respect to the longitudinal direction.

In some embodiments, when the electrical power contacts are mated to the first substrate and mounted to a second substrate, the electrical power contacts have a resistance at the mating interface of between approximately 0.02 milliohm and 0.025 milliohm.

In the electrical power connector may further comprise a plurality of electrical signal contacts supported by the housing and arranged along the longitudinal direction, each of the electrical signal contacts having a different geometry with respect to the plurality of electrical power contacts.

In accordance with one aspect of the present disclosure, an electrical interconnection system is described. The electrical interconnection system may comprise a substrate having a first surface and a second surface opposite the first surface, the first surface having a first pad disposed thereon and the second surface having a second pad disposed thereon;

an electrically insulative connector housing that defines a mating interface, wherein the mating interface further defines a slot, the connector housing further defining a mounting interface; a plurality of electrical power contacts supported by the connector housing and spaced along a longitudinal direction, each of the electrical power contacts defining a mating end disposed proximate to the mating interface, a mounting end that is opposite the mating end and disposed proximate to the mounting interface, and a contact body that extends from the mating end to the mounting end, each of the plurality of electrical power contacts having a portion that is planar and is disposed perpendicularly with respect to the longitudinal direction; and wherein each of the mating ends includes a first beam that extends from the contact body and a second beam that extends from the contact body, the first beam and the second beam disposed at opposed sides of the slot with respect to a transverse direction that is perpendicular to the longitudinal direction, and wherein, when the substrate is inserted in the slot along a lateral direction that is perpendicular to each of the transverse direction and the longitudinal direction, the first beam electrically contacts the first pad and the second beam electrically contacts the second pad.

In some embodiments, the first pad is configured to electrically contact at least six corresponding first beams and the second pad is configured to electrically contact at least six corresponding second beams.

In some embodiments, the first pad has a width, along the longitudinal direction, that is between 8 mm and 12 mm.

In some embodiments, the plurality of electrical power contacts are spaced, along the longitudinal direction, by a distance that is between approximately 0.7 mm and approximately 2 mm.

In some embodiments, the mating interface and the mounting interface are perpendicular to each other.

In some embodiments, the mating interface and the mounting interface are parallel to each other.

BRIEF DESCRIPTION OF THE DRAWINGS

The foregoing summary, as well as the following detailed description of example embodiments, are better understood when read in conjunction with the appended diagrammatic drawings. For the purpose of illustrating the invention, the drawings show embodiments that are presently preferred. The invention is not limited, however, to the specific instrumentalities disclosed in the drawings.

DETAILED DESCRIPTION

Figure 1A:
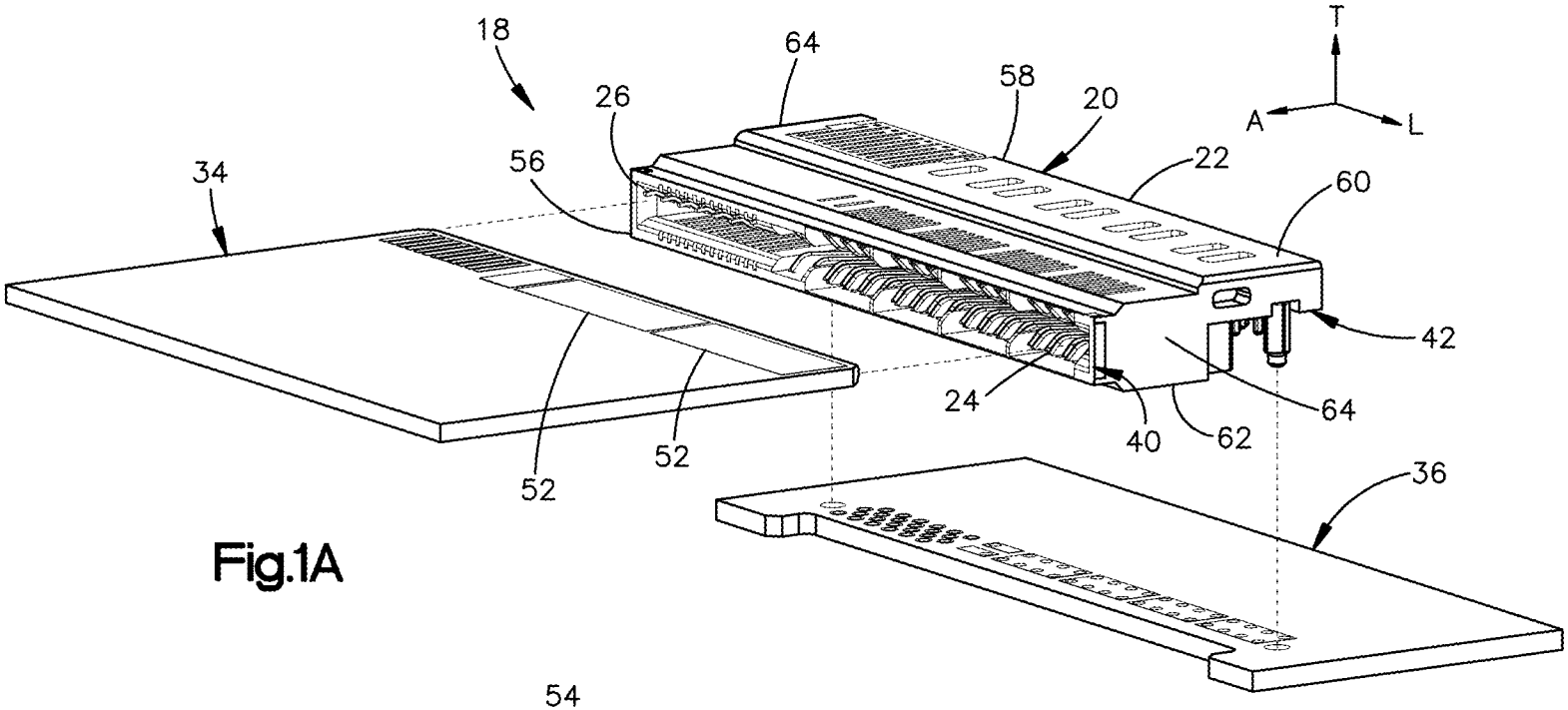
FIG. 1A is an exploded perspective view of an electrical power connector assembly constructed in accordance with one embodiment, including an electrical connector, a first substrate, and a second substrate.
Figure 1B:
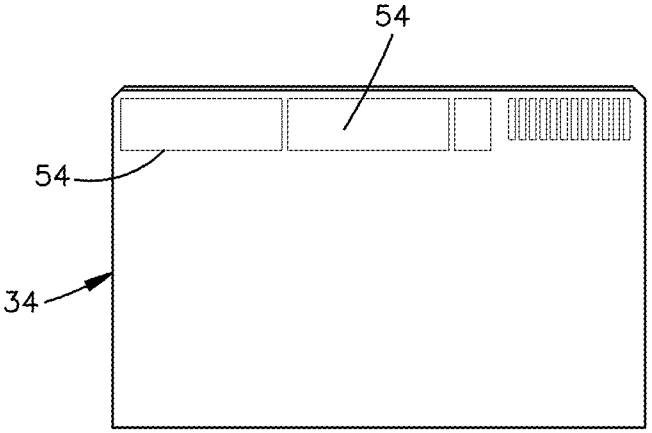
FIG. 1B is a bottom plan view of the first substrate illustrated in FIG. 1A.
Figure 2:
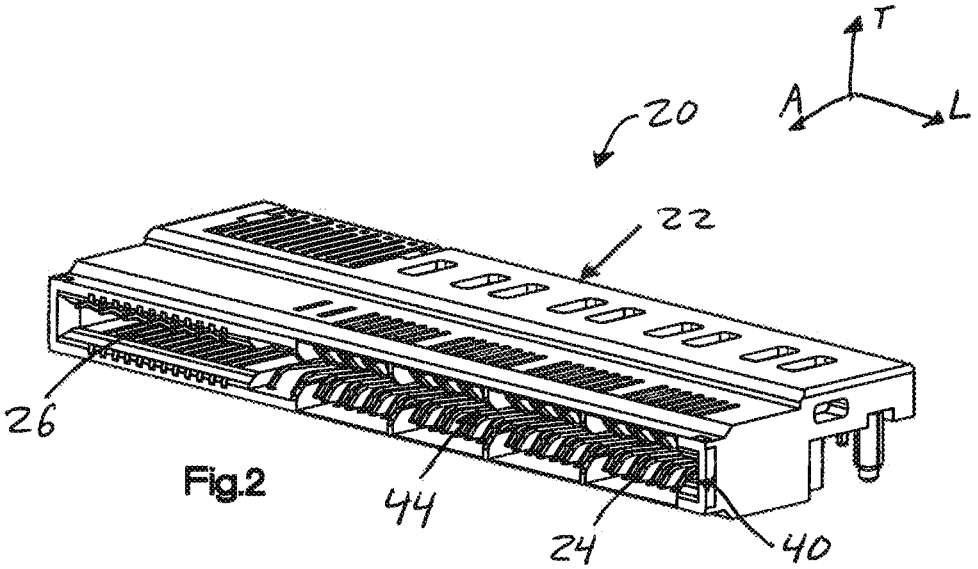
FIG. 2 is a perspective view of the electrical connector illustrated in FIG. 1A.
Figure 3:
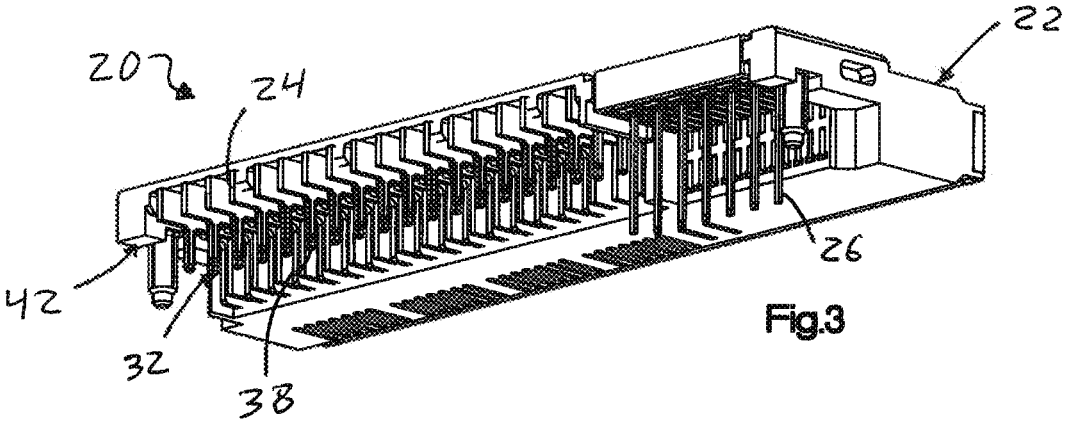
FIG. 3 is another perspective view of the electrical connector illustrated in FIG. 1A.
Figure 4:
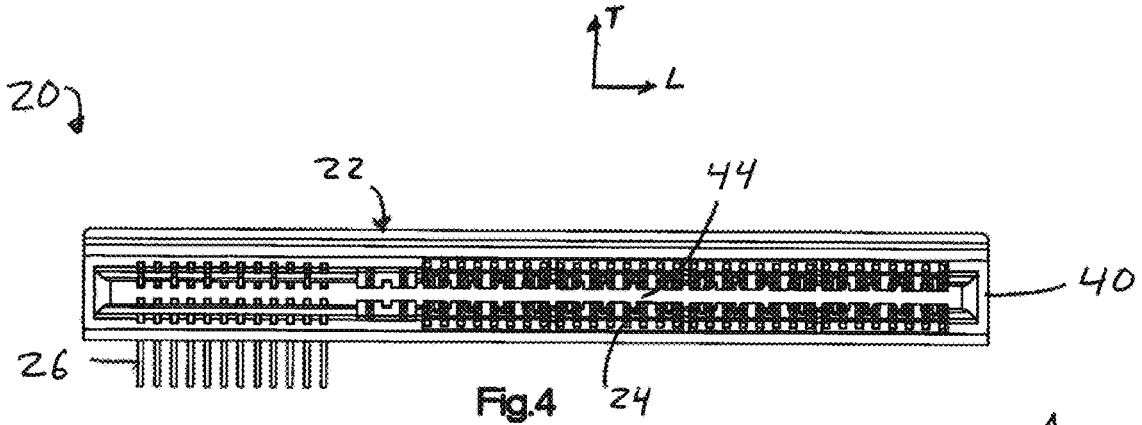
FIG. 4 is a front elevation view of the electrical connector illustrated in FIG. 1A.
Figure 5:
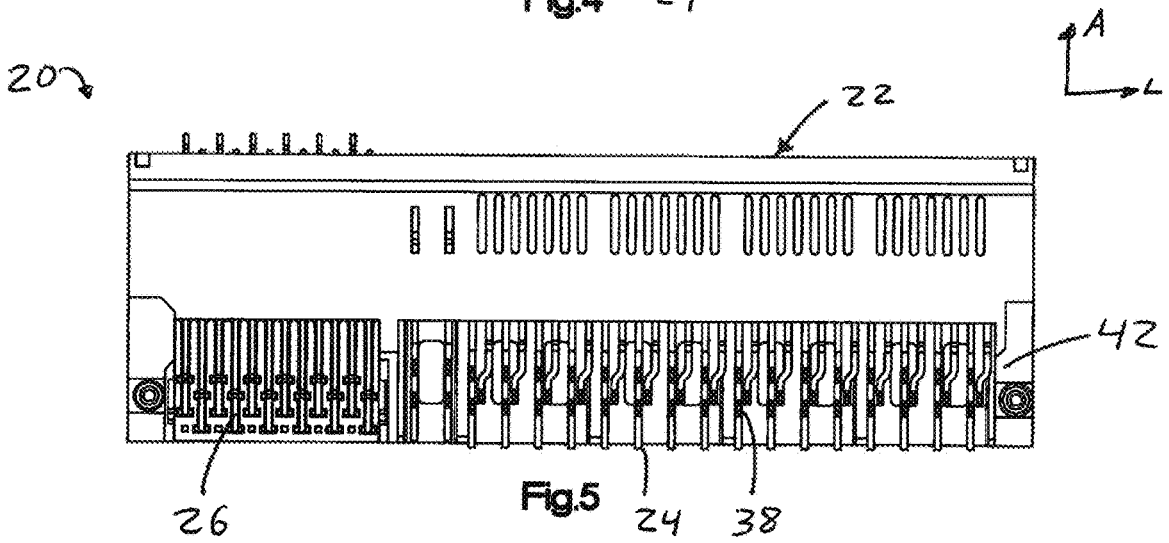
FIG. 5 is a bottom plan view of the electrical connector illustrated in FIG. 1A.

Referring to FIGS. 1A-6E, an electrical power connector 20 includes a dielectric or electrically insulative connector housing 22, and a plurality of electrical power contacts 24 supported by the connector housing 22. The power connector 20 can further include a plurality of electrical signal contacts 26 that are supported by the connector housing 22. The connector housing is illustrated as extending horizontally along a longitudinal direction "L" that defines a length of the housing 22, and a lateral direction "A" that defines a width of the housing 22, and vertically along a transverse direction "T" that defines a height of the housing 22. The housing 22 is elongate along the longitudinal direction L. Unless otherwise specified herein, the terms "lateral," "longitudinal," and "transverse" are used to describe the orthogonal directional components of connector 20 and its components. The terms "inner" and "outer," and "above" and "below" and derivatives thereof as used with respect to a specified directional component of a given apparatus are intended to refer to directions along the directional component toward and away from the geometric center of the apparatus, unless otherwise indicated.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the desired orientation of the connector 20. Accordingly, the terms "vertical" and "horizontal" are used to describe the connector 20 as illustrated merely for the purposes of clarity and convenience, it being appreciated that these orientations may change during use.

The electrical power contacts 24 are supported by the housing along a row that is oriented along the longitudinal direction L. Each of the power contacts 24 includes a contact body 28, a respective mating end 30 that extends from the contact body 28, and a mounting end 32 that is opposite the mating end 30 and extends from the contact body 28. Thus, the contact body 28 can extend from the mating end 30 to the mounting end 32. The contact body 28, the mating end 30, and the mounting end 32 can be monolithic with each other. The mating ends 30 are configured to mate with a first substrate 34, such as a printed circuit board (or PCB). The mounting ends 32 are configured to be mounted to a second substrate 36, thereby placing the first and second substrates 34 and 36 in electrical communication with each other. In this regard, it should be appreciated that an electrical power assembly 18 can include the power connector 20, and one or both of the first and second substrates 34 and 36. The mounting ends 32 can define mounting tails 38 that are configured to be press-fit into electrically plated holes of the second substrate 36, pin in paste, or surface mount (J-leads, ball grid array, and the like).

The housing 22 is longitudinally elongate, and defines laterally opposed front and rear ends 56 and 58, respectively, that are opposite each other along the lateral direction A, transverse upper and lower ends 60 and 62, respectively, that are opposite each other along the transverse direction T, and longitudinal ends 64 that are opposite each other along the longitudinal direction L. All connector housings 22 are described herein as being so oriented unless otherwise specified, it being appreciated that the orientation can change during use. The connector housing 22 defines a mating interface 40 and a mounting interface 42. The front end 56 defines a mating interface 40 of the housing 22. Thus, the mating ends 30 can be disposed proximate to the mating interface 40. The mounting ends 32 can be disposed proximate to the mounting interface 42. For instance, the mounting ends 32 can extend out from the mounting interface 42.

The power connector 20 can define a slot 44 that extends into the connector housing 22, for instance, at the mating interface 40. In one example, the electrical power connector 20 can be a right-angle connector, whereby the front end 56 defines the mating interface 40, and the lower end 62 defines the mounting interface 42. Thus, the mating interface 40 and the mounting interface 42 can be oriented perpendicular to each other. Alternatively, as is described in more detail below, the electrical power connector 20 can be a vertical connector, whereby the front end 56 defines the mating interface 40, and the rear end 58 defines the mounting interface 42. Thus, the mating interface 40 and the mounting interface 42 can be oriented parallel to each other.

Each of the mating ends 30 can include a first beam 46*a* that extends from the contact body and a second beam 46*b* that extends from the contact body. The first beam 46*a* and the second beam 46*b* can be disposed at opposed sides of the slot 44 with respect to the transverse direction T. The first beams 46*a* can be aligned with each other along the longitudinal direction L. Further, the first beams 46*a* can be spaced equidistantly from each other along the longitudinal direction L. Similarly, the second beams 46*b* can be aligned with each other along the longitudinal direction L. Further, the second beams 46*b* can be spaced equidistantly from each other along the longitudinal direction L. Further still, the first and second beams 46*a* and 46*b* of each of the power contacts 24 can be aligned with each other along the transverse direction T. Thus, the first substrate is configured to be received along the lateral direction A between the first beams 46*a* of the electrical power contacts 24 and the second beams 46*b* of the electrical power contacts 24. Thus, the lateral direction A can be referred to as an insertion direction along which the first substrate 34, and in particular an edge of the first substrate 34, is inserted between the first and second pluralities of beams 46*a* and 46*b*. In one example, the electrical power contacts 24 do not include any beams other than the first and second beams 46*a* and 46*b*.

When the power connector 20 is configured as a right-angle connector, the mating end 30 of each of the power contacts 24 can extend from the contact body 28 along the lateral direction A, and the mounting end 32 can extend from the contact body 28 along the transverse direction T. Thus, the mating ends 30 and the mounting ends 32 can be oriented perpendicular to each other. As will be described in more detail below, when the power connector 20 is configured as a vertical connector, the mating end 30 of each of the power contacts 24 can extend from the contact body 28 along the lateral direction A, and the mounting end 32 can extend from the contact body 28 along the lateral direction A. Thus, the mating ends 30 and the mounting ends 32 can be oriented parallel to each other.

The first substrate 34 can be configured as a printed circuit board. The first substrate 34 includes a first side 48 and a second side 50 opposite the first side 48 along the transverse direction. The edge of the first substrate 34 extends from the first side 48 to the second side 50. The first substrate 34 includes at least one first electrical contact pad 52 carried by the first side 48. For instance, the first substrate 34 can include a plurality of first electrical contact pads 52 carried by the first side that are aligned with each other along the longitudinal direction L. The first substrate 34 can further include at least one second electrical contact pad 54 carried by the second side 50. For instance, the first substrate 34 can include a plurality of second electrical contact pads 54 carried by the second side 50 that are aligned with each other along the longitudinal direction L. The first and second contact pads 52 and 54 can be aligned with each other along the transverse direction T. In some embodiments, the first and second contact pads may have a length, along the longitudinal direction L, that is between 8 mm and 12 mm, or within any suitable range within such range.

The electrical power contacts 24 can be spaced from each other along the longitudinal direction L a suitable distance such that the first beams 46*a* of at least six of the plurality of electrical power contacts 24 are configured to contact a first common electrical contact pad 52 of the first substrate 34 when the first substrate 34 is received in the slot 44. The power contacts 24 can include any number of at least six of the plurality of electrical power contacts 24 that are configured to contact a respective common one of the first electrical contact pads 52 as desired. For instance, the first beams 46*a* of between six and sixteen of the plurality of electrical power contacts 24 can be configured to contact the first common electrical contact pad 52 when the first substrate 34 is received in the slot 44. For instance, the first beams 46*a* of eight of the plurality of electrical power contacts 24 can be configured to contact the first common electrical contact pad 52 when the first substrate 34 is received in the slot 44. In one example, the first beams 46*a* of ten of the plurality of electrical power contacts 24 can be configured to contact the first common electrical contact pad 52 when the first substrate 34 is received in the slot 44.

Similarly, the electrical power contacts 24 can be spaced from each other along the longitudinal direction L a suitable distance such that the second beams 46*b* of at least six of the plurality of electrical power contacts 24 are configured to contact a second common electrical contact pad 54 of the first substrate 34 when the first substrate 34 is received in the slot 44. The power contacts 24 can include any number of at least six of the plurality of electrical power contacts 24 that are configured to contact a respective common one of the second electrical contact pads 54 as desired. For instance, the second beams 46*b* of between six and sixteen of the plurality of electrical power contacts 24 can be configured to contact the second common electrical contact pad 54 when the first substrate 34 is received in the slot 44. For instance, the second beams 46*b* of eight of the plurality of electrical power contacts 24 can be configured to contact the second common electrical contact pad 54 when the first substrate 34 is received in the slot 44. In one example, the second beams 46*b* of ten of the plurality of electrical power contacts 24 can be configured to contact the second common electrical contact pad 54 when the first substrate 34 is received in the slot 44.

A method of assembling the electrical power connector assembly 18 can include the step of inserting the first substrate 34 into the slot 44 so as to mate the at least six mating ends 30 with the first common electrical contact pad 52 of the first substrate 34. The inserting step can further mate the at least six mating ends 30 with the second common electrical contact pad 54 of the first substrate 34. The method can further include the step of mounting the mounting ends 32 to the second substrate 36. For instance, the mounting step can include inserting the mounting tails 38 into the electrically conductive holes of the second substrate 36.

Figure 6A:
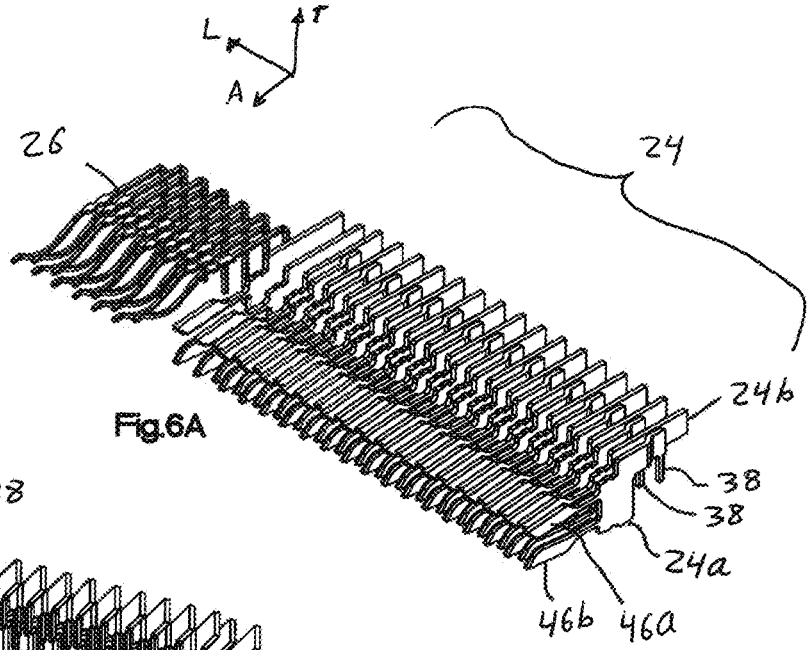
FIG. 6A is a perspective view of the electrical connector illustrated in FIG. 1A, but showing the connector housing removed to illustrate a plurality of electrical power contacts and signal contacts as arranged in the connector housing.
Figure 6B:
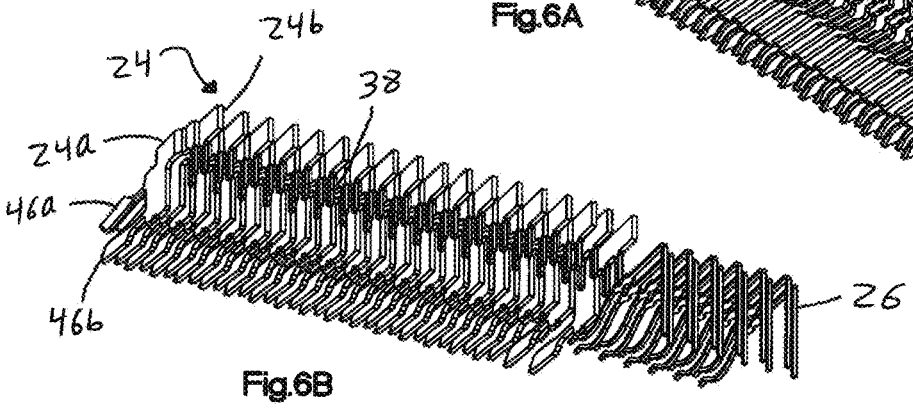
FIG. 6B is another perspective view of the electrical connector illustrated in FIG. 1A, but showing the connector housing removed to illustrate the plurality of electrical power contacts and signal contacts as arranged in the connector housing.
Figures 6C, 6D, 6E:
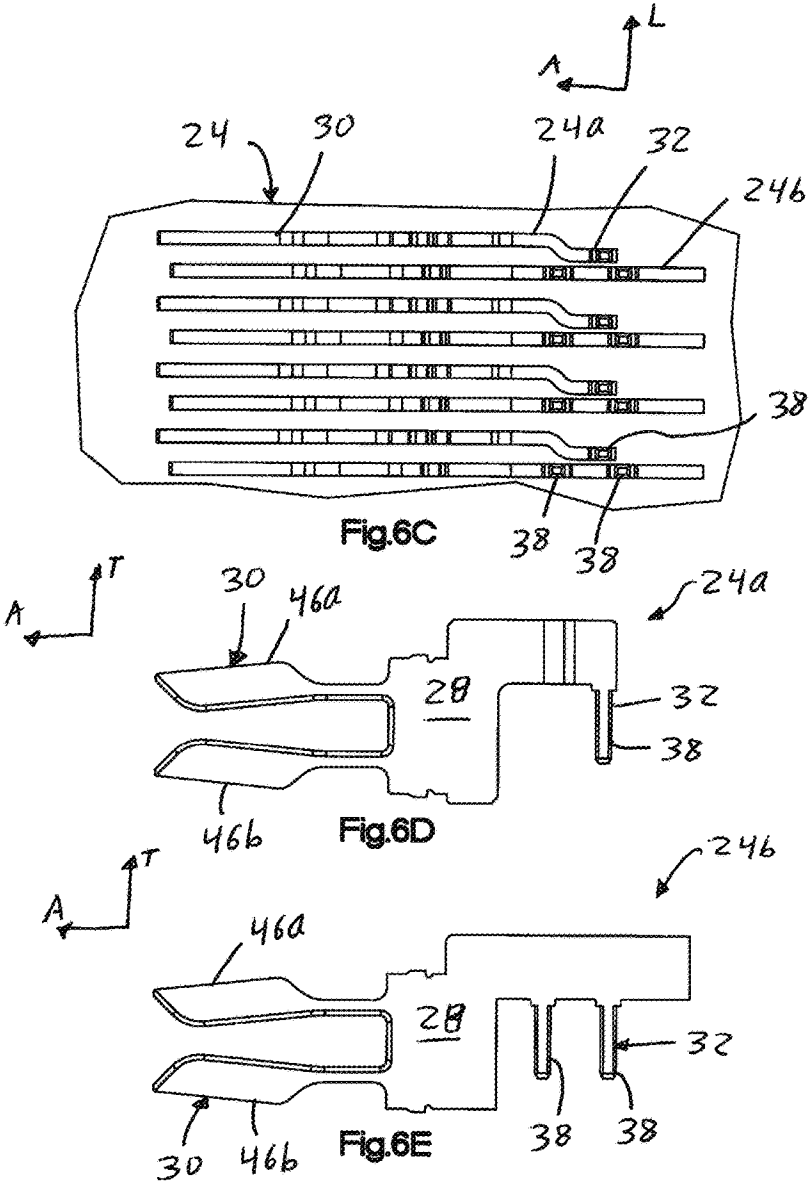
FIG. 6C is a bottom plan view of a portion of the electrical connector illustrated in FIG. 1A, but showing the connector housing removed to illustrate the plurality of electrical power contacts as arranged in the connector housing including a first group of the plurality of electrical power contacts and a second group of the plurality of electrical power contacts.
FIG. 6D is a side elevation view of the first group of the plurality of electrical power contacts illustrated in FIG. 6C.
FIG. 6E is a side elevation view of the second group of the plurality of electrical power contacts illustrated in FIG. 6C.
Figure 7A:
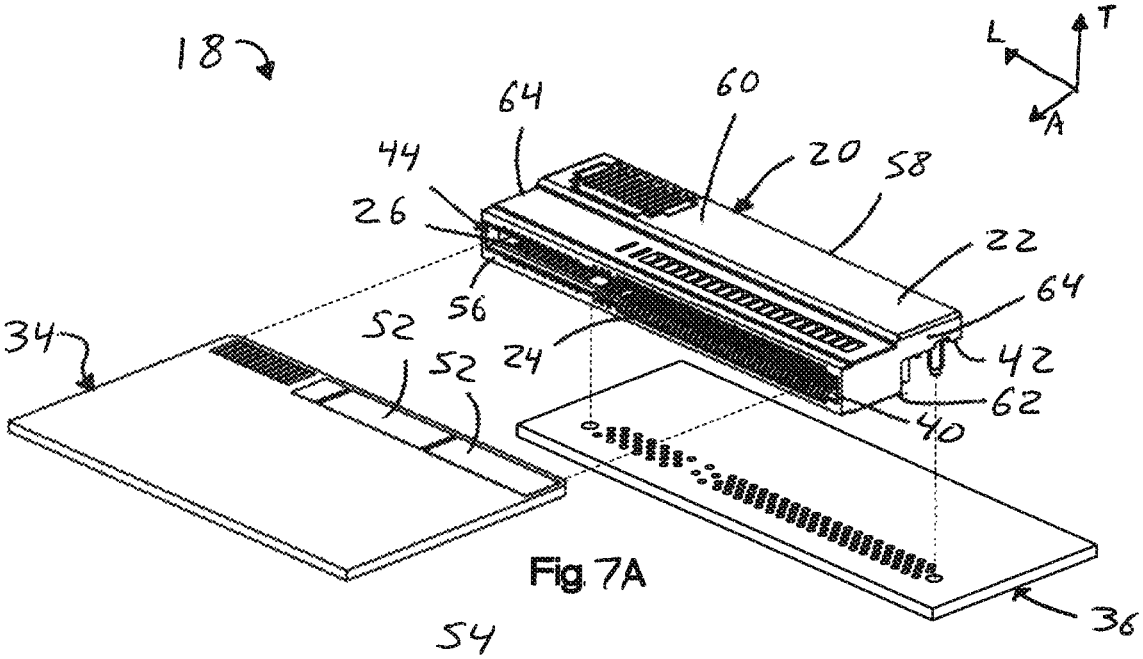
FIG. 7A is an exploded perspective view of an electrical power connector assembly constructed in accordance with another embodiment, including an electrical connector, a first substrate, and a second substrate.
Figure 7B:
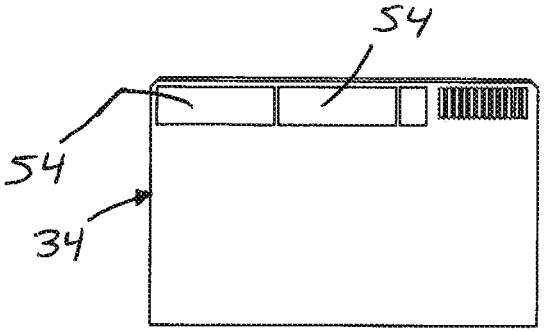
FIG. 7B is a perspective view of the first substrate illustrated in FIG. 7A.
Figure 8:
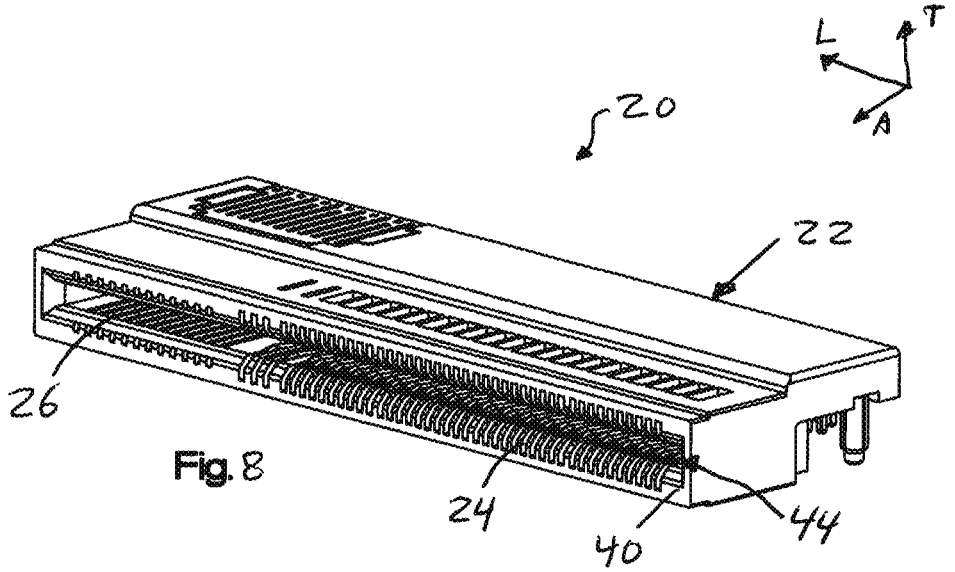
FIG. 8 is a perspective view of the electrical connector illustrated in FIG. 7A.
Figure 9:
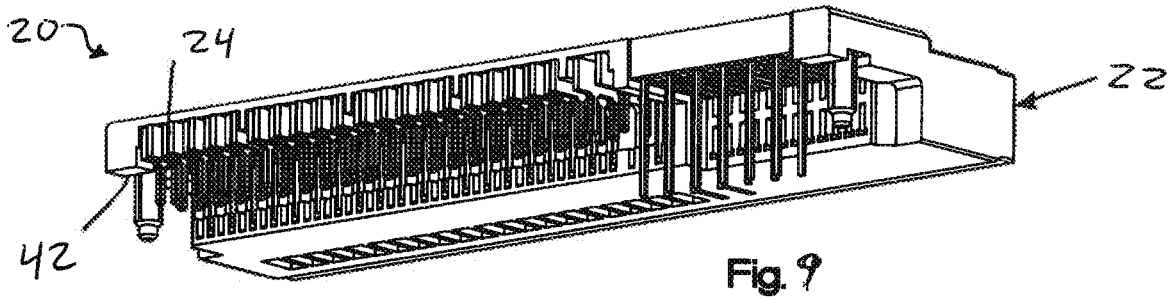
FIG. 9 is another perspective view of the electrical connector illustrated in FIG. 7A.
Figure 10:
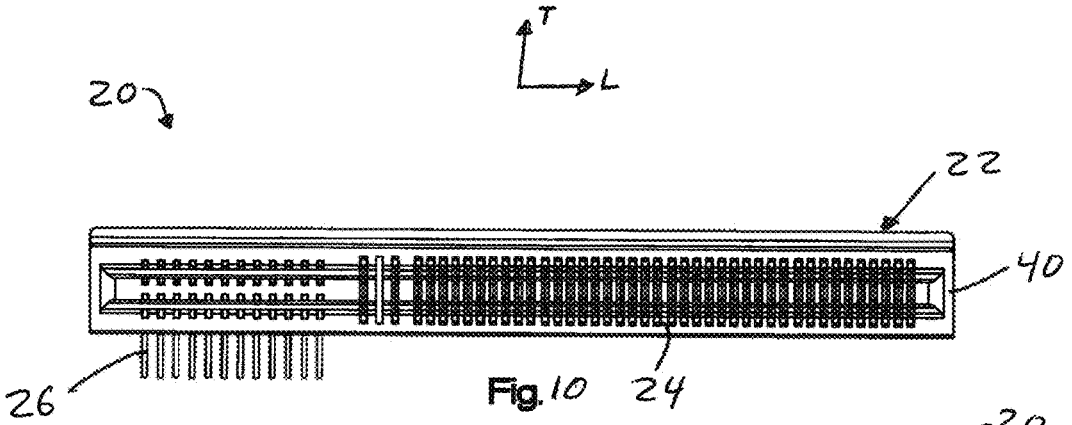
FIG. 10 is a front elevation view of the electrical connector illustrated in FIG. 7A.
Figure 11:
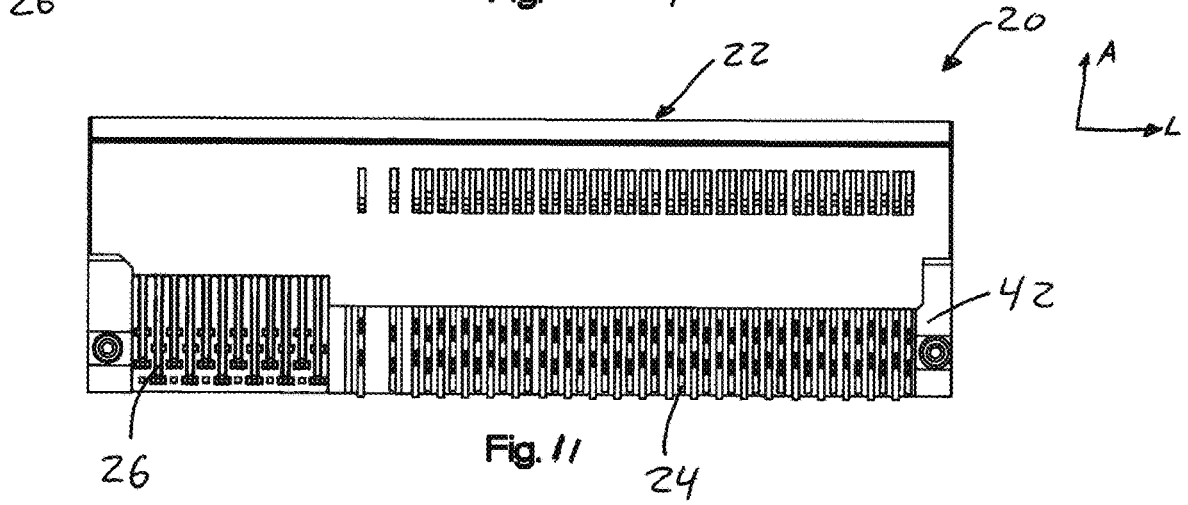
FIG. 11 is a rear elevation view of the electrical connector illustrated in FIG. 7A.
Figure 12A:
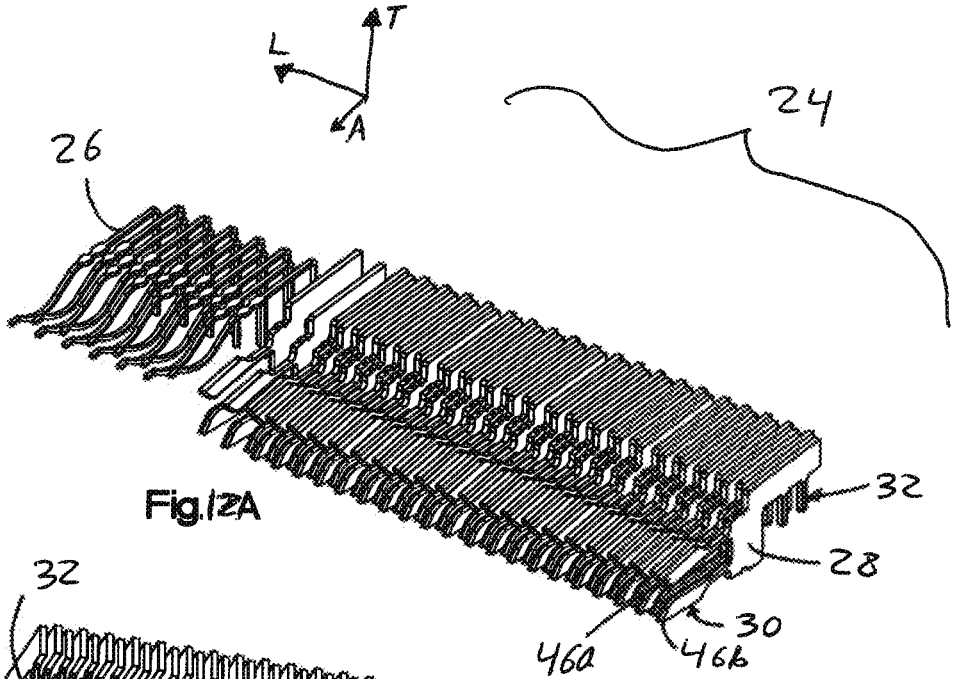
FIG. 12A is a perspective view of the electrical connector illustrated in FIG. 7A, but showing the connector housing removed to illustrate a plurality of electrical power contacts as arranged in the connector housing.
Figure 12B:
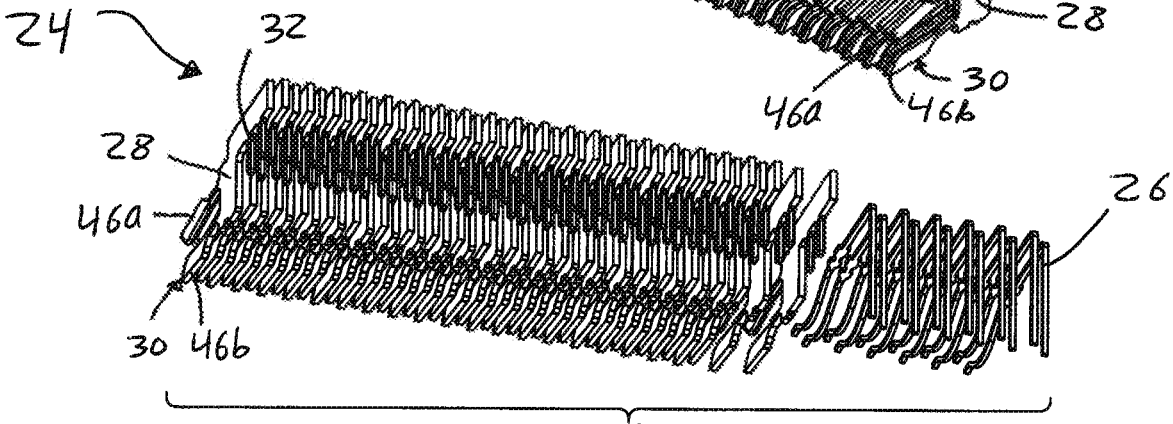
FIG. 12B is another perspective view of the electrical connector illustrated in FIG. 7A, but showing the connector housing removed to illustrate the plurality of electrical contacts as arranged in the connector housing.
Figures 12C, 12D, 12E:
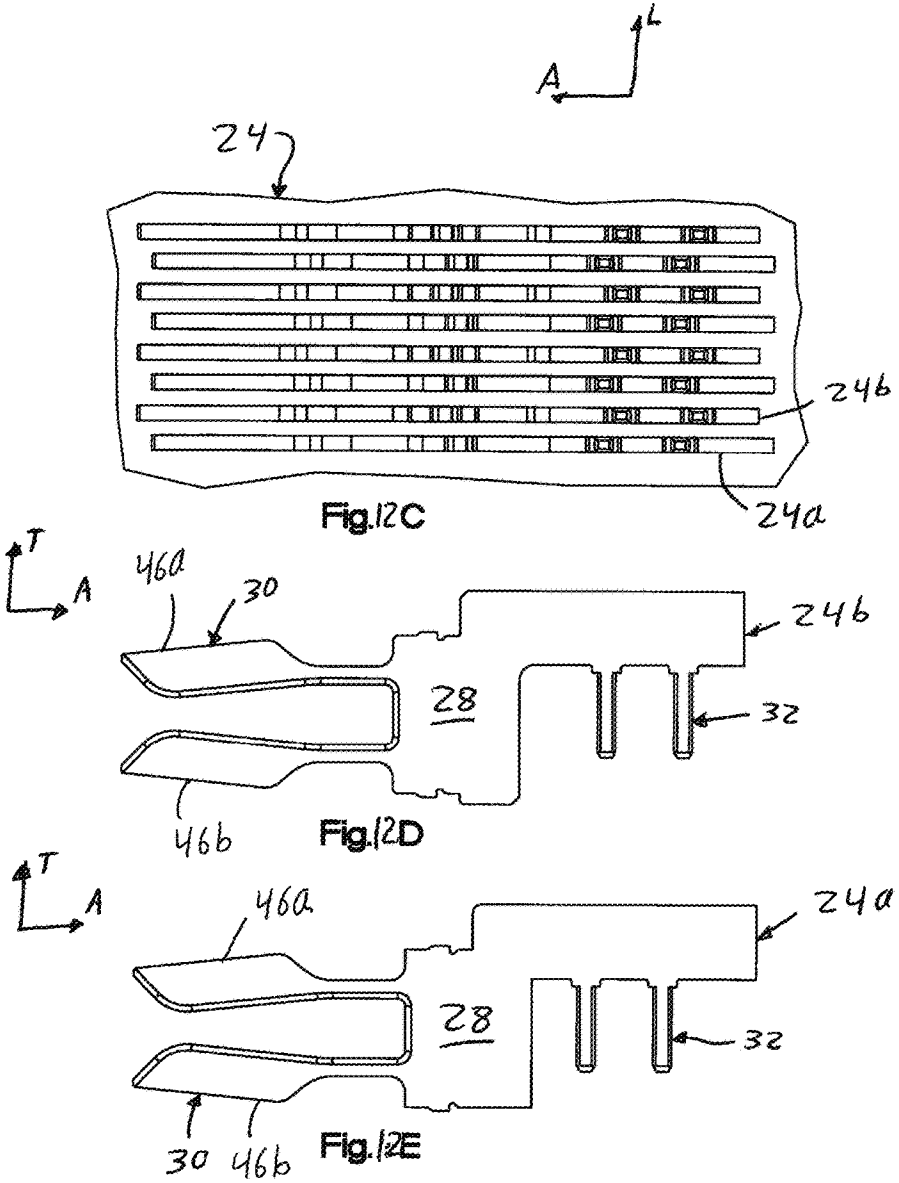
FIG. 12C is a rear elevation view of a portion of the electrical connector illustrated in FIG. 7A, but showing the connector housing removed to illustrate a plurality of electrical power contacts as arranged in the connector housing, including a first group of the plurality of electrical power contacts and a second group of the plurality of electrical power contacts.
FIG. 12D is a side elevation view of the first group of the plurality of electrical power contacts illustrated in FIG. 12C.
FIG. 12E is a side elevation view of a second plurality of the electrical power contacts illustrated in FIG. 12C.
Figure 13A:
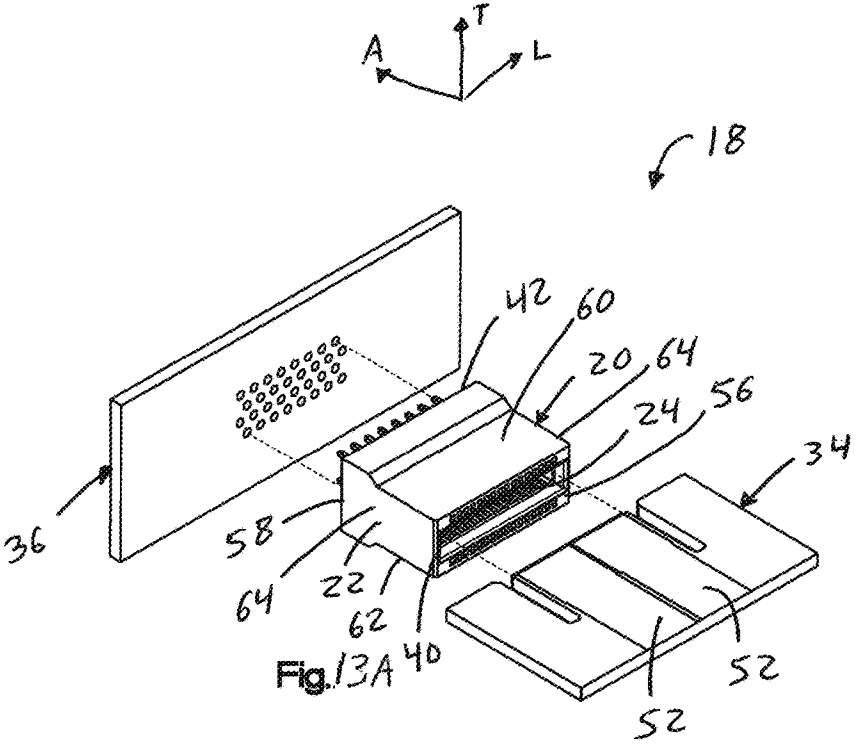
FIG. 13A is an exploded perspective view of an electrical power connector assembly constructed in accordance with another embodiment, including an electrical connector, a first substrate, and a second substrate.
Figure 13B:
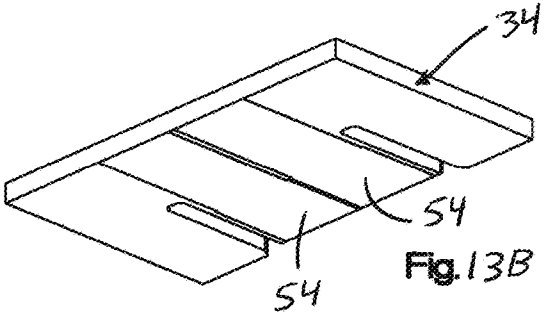
FIG. 13B is a bottom plan view of the first substrate illustrated in FIG. 13A.
Figure 14:
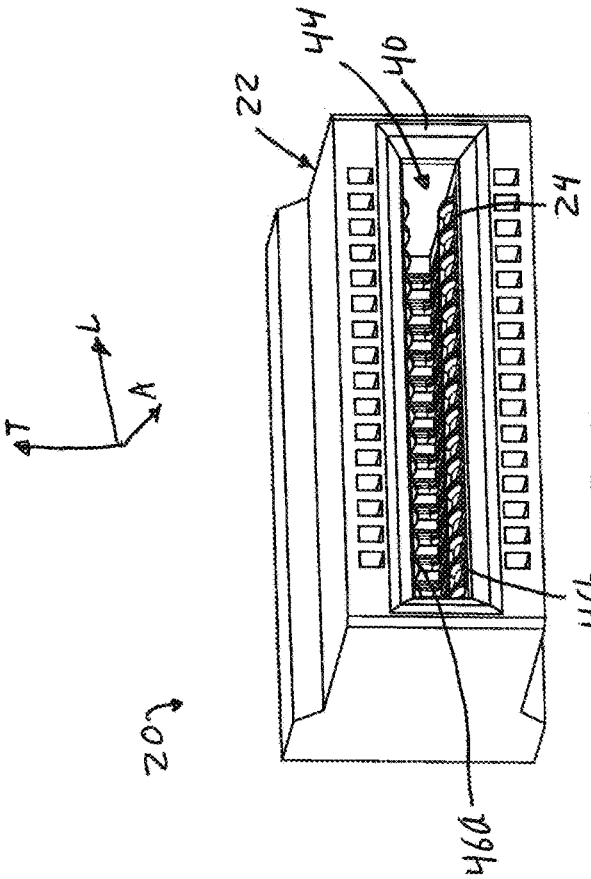
FIG. 14 is a perspective view of the electrical connector illustrated in FIG. 13A.
Figure 15:
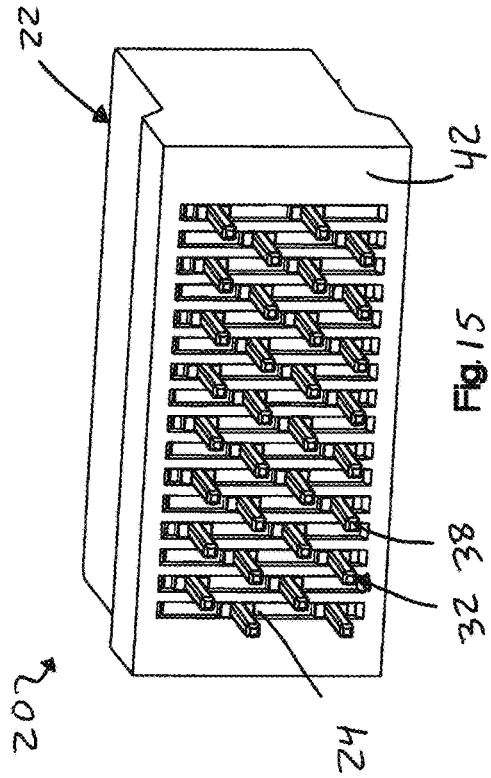
FIG. 15 is another perspective view of the electrical connector illustrated in FIG. 13A.
Figure 16:
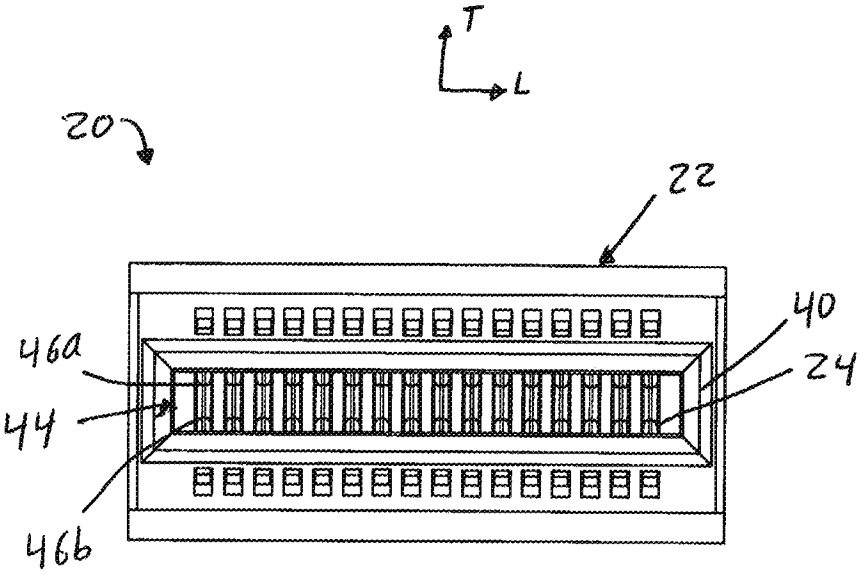
FIG. 16 is a front elevation view of the electrical connector illustrated in FIG. 13A.
Figure 17:
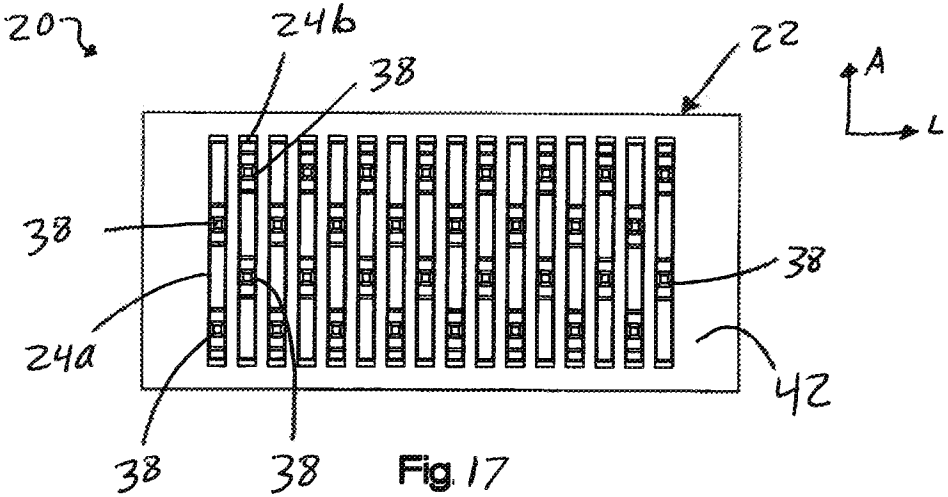
FIG. 17 is a bottom plan view of the electrical connector illustrated in FIG. 13A.
Figures 18A, 18B:
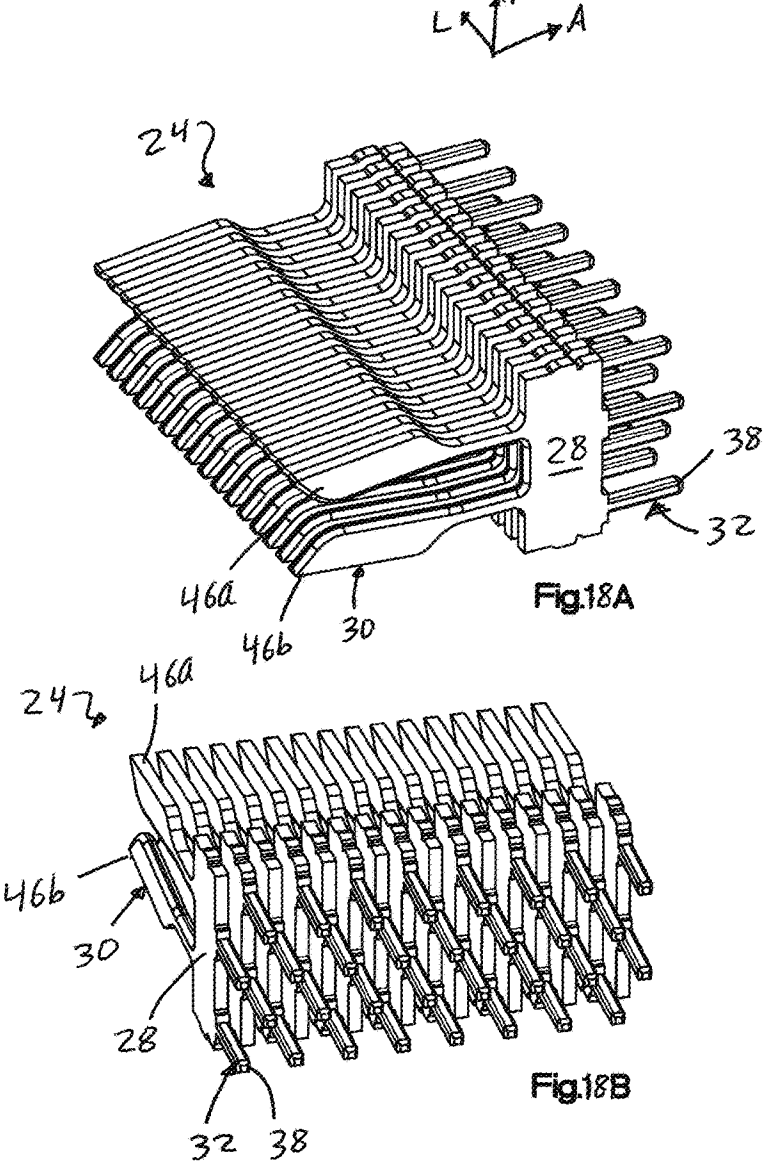
FIG. 18A is a perspective view of the electrical connector illustrated in FIG. 13A, but showing the connector housing removed to illustrate a plurality of electrical power contacts and signal contacts as arranged in the connector housing.
FIG. 18B is another perspective view of the electrical connector illustrated in FIG. 13A, but showing the connector housing removed to illustrate the plurality of electrical power contacts and signal contacts as arranged in the connector housing.
Figures 18C, 18D, 18E:
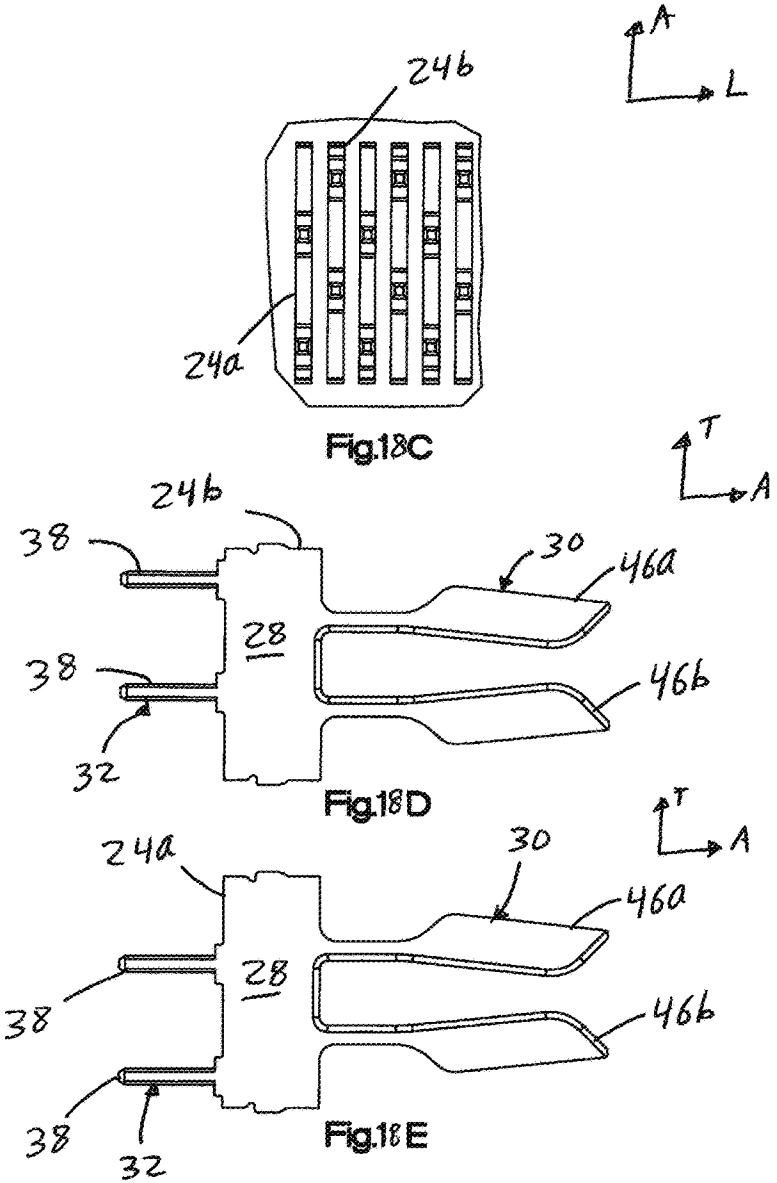
FIG. 18C is a bottom plan view of a portion of the electrical connector illustrated in FIG. 13A, but showing the connector housing removed to illustrate the plurality of electrical power contacts as arranged in the connector housing including a first group of the plurality of electrical power contacts and a second group of the plurality of electrical power contacts.
FIG. 18D is a side elevation view of the first group of the plurality of electrical power contacts illustrated in FIG. 18C.
FIG. 18E is a side elevation view of the second group of the plurality of electrical power contacts illustrated in FIG. 18C.

As illustrated in FIGS. 6D-6E, beams 46*a* and 46*b* may comprise a necked-down portion and a widened portion in some embodiments. The necked-down portion may be disposed between contact body 28 and the widened portion along the lateral direction A. In some embodiments, the ratio of the necked-down portion's width to the widened portion's width, with respect to the transverse direction T, may be selected so as to provide the beam with a desired elastic constant. Alternatively, or additionally, the ratio of the necked-down portion's length to the widened portion's length, with respect to the lateral direction A, may be selected so as to provide the beam with a desired elastic constant. In some embodiments, a necked-down portion may have a width that is between approximately 0.3 mm and approximately 0.7 mm, and a length that is between approximately 2 mm and approximately 4 mm. In some embodiments, a widened portion may have a width that is between approximately 1 mm and approximately 2 mm, and a length that is between approximately 3 mm and approximately 6 mm. In some embodiments, the ratio of the necked-down portion's width to the widened portion's width may be between 0.3 and 0.45 or within any suitable range within such range. In some embodiments, the ratio of the necked-down portion's length to the widened portion's length may be between 0.3 and 0.55, or within any suitable range within such range.

The mating ends 30 of the power contacts 24 can be spaced from each other along a center-to-center distance along the longitudinal direction L so as to define a contact pitch that is between and including approximately 0.7 mm and approximately 2 mm. The term "approximately" can refer to variations due, for instance, to manufacturing tolerances. For instance, the contact pitch can be between and including approximately 1 mm and approximately 1.5 mm. In one example, the contact pitch can be approximately 1.27 mm. The first beams 46*a* can thus be spaced from each other along the contact pitch along the longitudinal direction L. Similarly, the second beams 46*b* can be spaced from each other along the contact pitch along the longitudinal direction L. Further, at least a portion of the contact bodies 28 of the power contacts 24 can be spaced from each other along the contact pitch along the longitudinal direction L.

The electrical power contacts 24 can define an electrically conductive bulk material, as desired. For instance, the bulk material can be made from an electrically conductive material such as a copper alloy, copper iron, copper silicon nickel, copper chromium, beryllium-copper alloy or a palladium-nickel alloy. The electrically conductive material can have a low electrical resistance, such as approximately 80-95% conductivity. The power contacts 24 can include gold that is disposed on the bulk material at the mating ends 30. The power contacts can further include a silver-based finish that is applied to the gold at the mating ends 30.

The present disclosure recognizes that the electrical resistance of the electrical power contacts 24 of the electrical power assembly 18 can include three components. A first component is a bulk electrical resistance of the power contacts 24 from the mating ends 30 to the mounting ends 32. A second component is an electrical resistance at a mating interface of the mating ends 30 and the first substrate 34. A third component is an electrical resistance at a mounting interface of the mounting ends 32 and the second substrate 36. It is recognized that the electrical resistance at the mating interface, the mounting interface, and the bulk resistance of the power connector 20 be reduced with respect to conventional power connectors.

For instance, ten consecutive power contacts 24 mated to a common contact pad and mounted to the second substrate 36 can have a cumulative bulk resistance of between approximately 0.03 milliohm and approximately 0.035 milliohm. For instance, the cumulative bulk resistance can be approximately 0.0318 milliohm. Further, ten consecutive power contacts 24 mated to a common contact pad and mounted to the second substrate 36 can have a cumulative resistance at the mating interface of between approximately 0.015 milliohm and approximately 0.03 milliohm. For instance, the cumulative resistance at the mating interface can be approximately 0.022 milliohm. Further, ten consecutive power contacts 24 mated to a common contact pad and mounted to the second substrate 36 can have a cumulative resistance at the mounting interface of between approximately 0.002 milliohm and approximately 0.01 milliohm. For instance, the cumulative resistance at the mounting interface can be approximately 0.005 milliohm.

Further, as shown at Appendix A, when the power contacts 24 are arranged at a contact pitch of 1 mm, ten consecutive power contacts 24 mated to a contact pad on one side of a substrate at one of the first beams 46*a* and 46*b* are cumulatively configured to carry 48 amperes of electrical current at a 30 degrees Celsius temperature rise. Thus, ten consecutive power contacts 24, when both the first and second beams 46*a* and 46*b* are mated to a respective common contact pad located on opposed sides of the substrate, are cumulatively configured to carry 96 amperes of electrical current at a 30 degree Celsius rise. Conventional power connectors are configured to carry approximately 36 and 38 amperes, respectively, at a 30 degrees Celsius temperature rise over 10.16 mm when the four or five fingers/beams of the power contacts contact a contact pad on only one side of the substrate. When two conventional four or five finger/beam power contacts are positioned on opposed sides of a card receiving slot of the connector housing, the connectors are configured to carry 72 or 76 amperes, respectively. Stated another way, at a given current, the present connector 20 produces less heat than conventional power connectors.

The power contacts 24 can include first group 24*a* of power contacts 24 and a second group 24*b* of power contacts 24. Ones of the first group 24*a* are alternatingly arranged with ones of the second group 24*b* along the longitudinal direction L. Further, the first group 24*a* of power contacts 24 can have a different geometry than second group 24*b* of power contacts 24. For instance, the different geometry can be one or both of a position of the mounting ends 32 and a different number of mounting tails 38 at the mounting ends 32. In one example, the geometry can include at least one of a number of mounting tails 38 and a position of mounting tails 38 along a plane that is defined by the lateral direction A and the transverse direction T. When the power connector 20 is a right-angle connector, the position of the mounting tails 38 can be along the lateral direction A. When the power connector 20 is a vertical connector, the position of the mounting tails 38 can be along the transverse direction T. The mounting end 32 of each of the second group 24*b* of power contacts 24 can include more than one mounting tail that extend from the contact body. For example, the mounting end 32 of each of the second group 24*b* of power contacts 24 can include first and second mounting tails 38 that extend from the contact body 28 and are spaced from each other along the plane. In one example, the mounting end 32 of each of the second group 24*b* of power contacts 24 includes no more than the first and second mounting tails 38 of the second group 24*b*. The mounting end 32 of each of the first group 24*a* of power contacts 24 includes a single mounting tail 38 that extends from the respective contact body 28. In one example, the mounting end 32 of each of the first group 24*a* of power contacts 24 includes only the single mounting tail 38 and no other mounting tails.

The single mounting tails 38 of the first group 24*a* of power contacts 24 can be aligned with each other along the longitudinal direction L. The first mounting tails 38 of the second group 24*b* of power contacts 24 can be aligned with each other along the longitudinal direction L, and the second mounting tails 38 of the second group 24*b* of power contacts 24 can be aligned with each other along the longitudinal direction L. The single mounting tail of each of the first group of power contacts is offset from each of the first mounting tails of all of the second group of power contacts a first distance along the plane, and is offset from each of the second mounting tails of all of the second group of power contacts a second distance along the plane. The second distance can be different than the first distance. Alternatively, the second distance can be approximately equal to the first distance.

The single mounting tail 38 of each of the first group 24*a* of power contacts 24 can be disposed between the first mounting tails 38 of all of the second group 24*b* of power contacts 24 and the second mounting tails 38 of all of the second group 24*b* of power contacts 24. For instance, when the power connector 20 is a right-angle connector, such that the mating ends 30 extend from the contact body 28 along the lateral direction A and the mounting ends 32 extend from the contact body 28 along the transverse direction T, the single mounting tail 38 of each of the first group 24*a* of power contacts 24 can be disposed between the first mounting tails 38 of all of the second group 24*b* of power contacts 24 and the second mounting tails 38 of all of the second group 24*b* of power contacts 24 with respect to the lateral direction A. The single mounting tail 38 of each of the first group 24*a* of power contacts 24 can be offset from each of the first mounting tails 38 of all of the second group 24*b* of power contacts 24 a first distance along the lateral direction A, and can be offset from each of the second mounting tails 38 of all of the second group 24*b* of power contacts 24 a second distance along the lateral direction A that is different than the first distance. The first and second mounting tails 38 of the second group 24*b* of power contacts 24 can be disposed such that the mating ends 30 of the second group 24*b* are disposed closer to the first mounting tails 38 than the second mounting tails 38 along the lateral direction A. The single mounting tails of the first group 24*a* can be disposed closer to the second mounting tails than the first mounting tails with respect to the lateral direction.

As described above, at least a portion of the contact bodies 28 of the first group 24*a* can be spaced at the contact pitch described above. For instance, the contact bodies 28 of the first group 24*a* can be jogged along the longitudinal direction L at a location between the mating ends 30 and the mounting ends 32. Accordingly, the contact bodies 28 can define a first section and a second section that is jogged along the longitudinal direction L with respect to the first section. The second section can be disposed between the mounting end 32 and the first section. The first section can be disposed between the mating end 30 and the second section. The first and second sections can be spaced from each other along the lateral direction. Thus, the mounting ends 32, such as the mounting tails 38, of each of the power contacts 24 of the first group 24*a* can be out of plane with the mating ends 30, and in particular with each of the first and second beams 46*a* and 46*b*, with respect to a plane that is defined by the transverse direction T and the lateral direction A. The mounting ends 32 can be offset from the plane along the longitudinal direction L. It should thus be appreciated that the second section can flare toward an adjacent one of the second group 24*b* of power contacts 24. However, an entirety of the first group 24*a* of power contacts 24, including the second section, is spaced from all others of the power contacts 24 along the longitudinal direction L. It should be appreciated that by jogging the first group 24*a* of electrical contacts 24, the position of the mounting tails 38 of the first group 24*a* can be adjusted so as to define a desired footprint that is compatible with the footprint of plated holes of the second substrate 36.

The power connector 20 can include a plurality of signal contacts 26 that can be disposed at either longitudinal end 64 of the connector 20. Alternatively, the signal contacts 26 can be disposed between the longitudinal ends 64, for instance at or longitudinally offset from, the longitudinal center of the connector 20. The signal contacts 26 are configured to mate with the first substrate 34 and mount to the second substrate 36. Alternatively still, the power connector 20 can be devoid of signal contacts 26.

Referring now to FIGS. 7A-12E, the mounting end 32 of each of the first group 24*a* of power contacts 24 can include first and second mounting tails 38. The second mounting tails 38 of the first group 24*a* of power contacts 24 can be disposed between the first and second mounting tails 38 of the second group 24*b* of power contacts 24 with respect to the lateral direction A. For instance, the second mounting tails 38 of the first group 24*a* of power contacts can be offset equidistantly between the first and second mounting tails 38 of the second group 24*b* of power contacts 24 with respect to the lateral direction A. Alternatively, the second mounting tails 38 of the first group 24*a* of power contacts can be offset at different distances from the first mounting tails 38 than the second mounting tails 38 of the second group 24*b* of power contacts 24 with respect to the lateral direction A. Similarly, the first mounting tails 38 of the second group 24*b* of power contacts 24 can be disposed between the first and second mounting tails 38 of the first group 24*a* of power contacts 24 with respect to the lateral direction A. The first mounting tails 38 of the second group 24*b* of power contacts 24 can be offset equidistantly between the first and second mounting tails 38 of the first group 24*a* of power contacts 24 with respect to the lateral direction A. Alternatively, the first mounting tails 38 of the second group 24*b* of power contacts 24 can be offset at different distances from the first mounting tails 38 than the second mounting tails 38 of the first group 24*a* of power contacts 24 with respect to the lateral direction A.

Further, while the power contacts 24 of the first group 24*a* can be jogged in the longitudinal direction L as described above with respect to FIGS. 1A-6E, the power contacts 24 of the first group 24*a* can be entirely planar as illustrated in FIGS. 7A-12E. In particular, an entirety of the contact body 28 of each of the first group 24*a* of power contacts 24 can be planar along the transverse direction T and the lateral direction A. Thus, the mating ends 30 and the mounting ends 32 of each of the first group 24*a* of power contacts 24 can lie on a first plane that is defined by the lateral direction A and the transverse direction T. Similarly, the mating ends 30 and the mounting ends 32 of each of the second group 24*b* of power contacts 24 can lie on a second plane that is defined by the lateral direction A and the transverse direction T. Thus, the second plane is parallel to the first plane.

Referring now to FIGS. 13A-18E the electrical connector 20 can be configured as a vertical electrical connector, whereby the mating ends 30 and the mounting ends extend from the respective contact bodies 28 in opposite directions along the lateral direction A. Thus, the second mounting tails of the first group of power contacts are disposed between the first and second mounting tails of the second group of power contacts with respect to the transverse direction. For instance, the second mounting tails 38 of the first group 24*a* of power contacts 24 can be offset equidistantly between the first and second mounting tails 38 of the second group 24*b* of power contacts 24 with respect to the transverse direction T. Alternatively, the second mounting tails 38 of the first group 24*a* of power contacts can be offset at different distances from the first mounting tails 38 than the second mounting tails 38 of the second group 24*b* of power contacts 24 with respect to the transverse direction T. Similarly, the first mounting tails 38 of the second group 24*b* of power contacts 24 can be disposed between the first and second mounting tails 38 of the first group 24*a* of power contacts 24 with respect to the transverse direction T. For instance, the first mounting tails 38 of the second group 24*b* of power contacts 24 can be offset equidistantly between the first and second mounting tails 38 of the first group 24*a* of power contacts 24 with respect to the transverse direction T. Alternatively, the first mounting tails 38 of the second group

24*b* of power contacts can be offset at different distances from the first mounting tails 38 than the second mounting tails 38 of the first group 24*a* of power contacts 24 with respect to the transverse direction T.

When the power connector 20 is a vertical connector, ten consecutive power contacts 24 mated to a common contact pad and mounted to the second substrate 36 can have a cumulative bulk resistance of between approximately 0.02 milliohm and approximately 0.025 milliohm. For instance, the cumulative bulk resistance can be approximately 0.023 milliohm. Further, ten consecutive power contacts 24 mated to a common contact pad and mounted to the second substrate 36 can have a cumulative resistance at the mating interface of between approximately 0.02 milliohm and approximately 0.025 milliohm. For instance, the cumulative resistance at the mating interface can be approximately 0.022 milliohm. Further, ten consecutive power contacts 24 mated to a common contact pad and mounted to the second substrate 36 can have a cumulative resistance at the mounting interface of between approximately 0.002 milliohm and approximately 0.004 milliohm. For instance, the cumulative resistance at the mounting interface can be approximately 0.003 milliohm. The vertical power contacts 24 can further have a thermal rating of 125 degrees Celsius.

Figure 19:
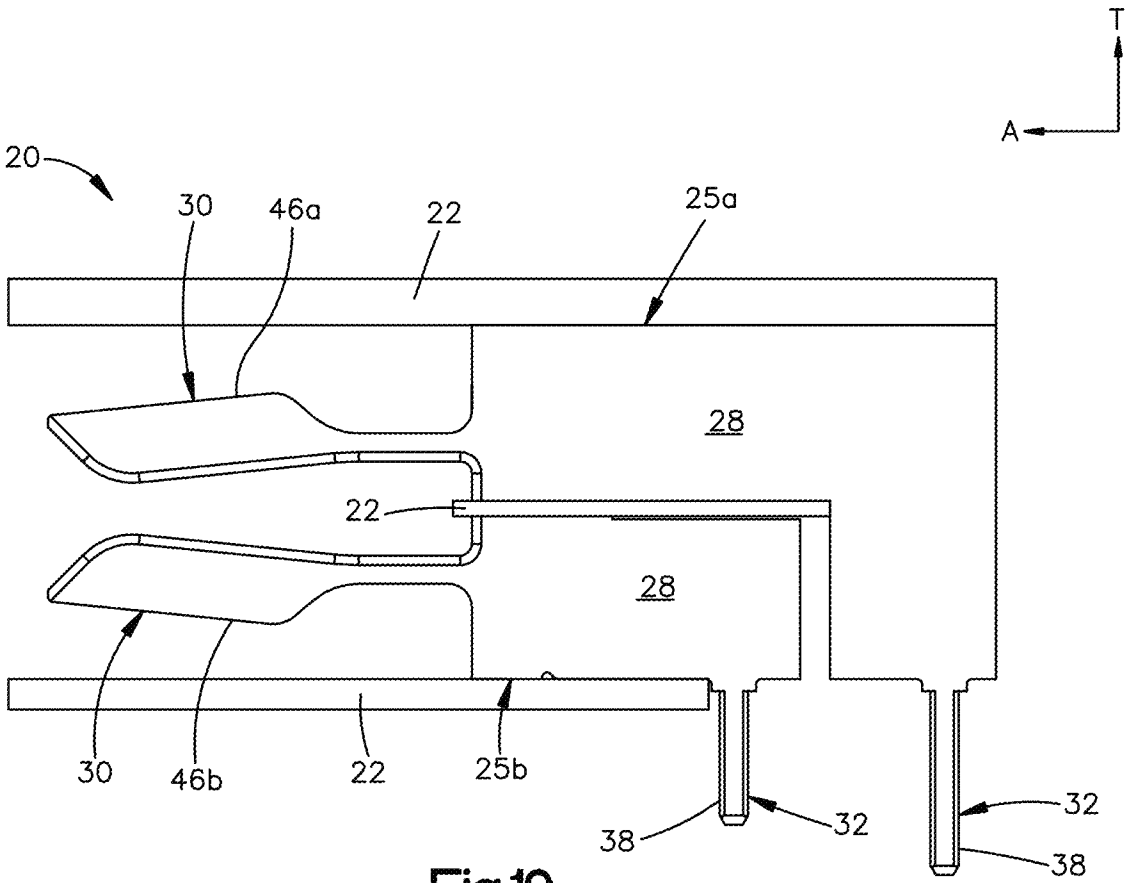
FIG. 19 is a side elevation view of an electrical power contact constructed in accordance with an alternative embodiment.

Referring now to FIG. 19, it is appreciated that the electrical power connectors 20 described above include a plurality of electrical power contacts 24 whose mating ends 30 each include the first beam 46*a* and the second beam 46*b*. In accordance with an alternative embodiment, the electrical power connector 20 can include a first plurality of electrical contacts 25*a* that include the first beam 46*a* at their respective mating ends 30, and a second plurality of electrical contacts 25*b* that include the second beam 46*b* at their respective mating ends. The first and second pluralities of electrical contacts 25*a* and 25*b* can be supported by the connector housing 22 so as to be electrically isolated from each other. Thus, electrical power can flow to or from the first common contact pad 52 and separately to or from the second contact pad 54 without placing the first and second contact pads 52 and 54 in electrical communication with each other. The connector housing 22 can include a portion disposed between the first and second electrical contacts 25*a* and 25*b* so as to engage the first and second electrical contacts 25*a* and 25*b* and provide for retention of the contacts 25*a* and 25*b* in the connector housing 22. The first electrical contacts 25*a* and 25*b* can include the first and second groups as described above, and the second electrical contacts 25*a* and 25*b* can include the first and second groups as described above. It should be appreciated that while the first and second electrical contacts 25*a* and 25*b* are illustrated as right-angle contacts, whereby the beams 46*a* and 46*b* are oriented perpendicular with respect to the mounting tails 38, the first and second electrical contacts 25*a* and 25*b* can alternatively be configured as vertical contacts, whereby the beams 46*a* and 46*b* are oriented parallel to the mounting tails 38 as described above.

In some embodiments, an electrical power connector may include any suitable combination of the features described below.

An electrically insulative connector housing that defines a mating interface, wherein the mating interface further defines a slot, the connector housing further defining a mounting interface; a plurality of electrical power contacts supported by the connector housing and arranged along a longitudinal direction, each of the electrical power contacts defining a mating end disposed proximate to the mating interface, a mounting end that is opposite the mating end and disposed proximate to the mounting interface, and a contact body that extends from the mating end to the mounting end; wherein each of the mating ends includes a first beam that extends from the contact body and a second beam that extends from the contact body, the first beam and the second beam disposed at opposed sides of the slot with respect to a transverse direction that is perpendicular to the longitudinal direction, such that a first substrate is configured to be received between the first beams of the electrical power contacts and the second beams of the electrical power contacts along a lateral direction that is perpendicular to each of the transverse direction and the longitudinal direction, and wherein the electrical power contacts are spaced from each other along the longitudinal direction such that the first beams of at least six of the plurality of electrical power contacts are configured to contact a first common electrical contact pad of the first substrate when the first substrate is received in the slot.

In some embodiments, the first beams of the at least six of the plurality of electrical power contacts are spaced equidistantly along the longitudinal direction In some embodiments, the first beams are aligned with each other along the longitudinal direction.

In some embodiments, the second beams of the at least six of the plurality of electrical power contacts are configured to contact a second common electrical contact pad of the substrate that faces opposite the first common electrical contact pad.

In some embodiments, the second beams are aligned with each other along the longitudinal direction.

In some embodiments, the first and second beams of each of the electrical power contacts are aligned with each other along the transverse direction.

In some embodiments, the mating ends of the at least six of the plurality of electrical power contacts does not include any beams other than the first and second beams.

In some embodiments, the first beams of between six and sixteen of the plurality of electrical power contacts are configured to contact the first common electrical contact pad when the substrate is received in the slot.

In some embodiments, the first beams of eight of the plurality of electrical power contacts are configured to contact the first common electrical contact pad when the substrate is received in the slot.

In some embodiments, the first beams of ten of the plurality of electrical power contacts are configured to contact the first common electrical contact pad when the substrate is received in the slot.

In some embodiments, the second beams of between six and sixteen of the plurality of electrical power contacts are configured to contact the second common electrical contact pad when the substrate is received in the slot.

In some embodiments, the second beams of eight of the plurality of electrical power contacts are configured to contact the second common electrical contact pad when the substrate is received in the slot.

In some embodiments, the second beams of ten of the plurality of electrical power contacts are configured to contact the second common electrical contact pad when the substrate is received in the slot.

In some embodiments, wherein the first beams of the at least six electrical power contacts are spaced from each other center-to-center along the longitudinal direction at a contact pitch that is between approximately 0.7 mm and approximately 2 mm.

In some embodiments, the contact pitch is approximately 1.27 mm.

In some embodiments, the second fingers of the at least six electrical power contacts are spaced center-to-center along the longitudinal direction at the contact pitch.

In some embodiments, the power contacts are mated to the first substrate and mounted to a second substrate, the power contacts have a resistance at the mating interface of between approximately 0.02 milliohm and 0.025 milliohm.

In some embodiments, current density is approximately 48 amperes per 10.16 mm along the longitudinal direction on one side of the first substrate.

In some embodiments, the at least six electrical power contacts comprise a first group of power contacts and a second group of power contacts, ones of the first group are alternatingly arranged with ones of the second group along the longitudinal direction, and the first group of power contacts has a different geometry than second group of power contacts.

In some embodiments, all of the electrical power contacts comprise the first and second groups of power contacts, and ones of the first group are alternatingly arranged with ones of the second group along the longitudinal direction.

In some embodiments, the different geometry comprises a position of the mounting ends and a different number of mounting tails at the mounting ends.

In some embodiments, an entirety of the first group of power contacts are spaced from all others of the power contacts along the longitudinal direction.

In some embodiments, the geometry comprises at least one of a number of mounting tails and a position of mounting tails along a plane that is defined by the lateral direction and the transverse direction.

In some embodiments, the mounting end of each the first group of power contacts includes a single mounting tail that extends from the contact body, and the mounting end of each of the second group of power contacts includes more than one mounting tail that extend from the contact body.

In some embodiments, the single mounting tails of the first group of power contacts are aligned with each other along the longitudinal direction.

In some embodiments, the mounting end of each of the second group of power contacts includes first and second mounting tails that extend from the contact body and are spaced from each other along the plane.

In some embodiments, the mounting end of each of the second group of power contacts includes no more than the first and second mounting tails.

In some embodiments, the first mounting tails of the second group of power contacts are aligned with each other along the longitudinal direction, and the second mounting tails of the second group of power contacts are aligned with each other along the longitudinal direction.

In some embodiments, the single mounting tail of each of the first group of power contacts is offset from each of the first mounting tails of all of the second group of power contacts a first distance along the plane, and is offset from each of the second mounting tails of all of the second group of power contacts a second distance along the plane that is different than the first distance.

In some embodiments, the single mounting tail of each of the first group of power contacts is disposed between the first mounting tails of all of the second group of power contacts and the second mounting tails of all of the second group of power contacts.

In some embodiments, the mating ends extend from the contact body along the lateral direction, and the mounting ends extend from the contact body along the transverse direction.

In some embodiments, the single mounting tail of each of the first group of power contacts is offset from each of the first mounting tails of all of the second group of power contacts a first distance along the lateral direction, and is offset from each of the second mounting tails of all of the second group of power contacts a second distance along the lateral direction.

In some embodiments, the single mounting tail of each of the first group of power contacts is disposed between the first mounting tails of all of the second group of power contacts and the second mounting tails of all of the second group of power contacts.

In some embodiments, the mating ends of the second group of power contacts are disposed closer to the first mounting tails than the second mounting tails along the lateral direction, and the single mounting tails are disposed closer to the second mounting tails than the first mounting tails with respect to the lateral direction.

In some embodiments, the mounting ends of each of the power contacts of the first group are out of plane with each of the first and second beams with respect to a plane that is defined by the transverse direction and the lateral direction.

In some embodiments, the contact body of each of the power contacts of the first group includes a first section and a second section that is jogged along the longitudinal direction with respect to the first section.

In some embodiments, the second distance is different than the first distance.

In some embodiments, the mounting end of each of the first group of power contacts includes only the single mounting tail and no other mounting tails.

In some embodiments, the mounting end of each of the first group of power contacts includes first and second mounting tails.

In some embodiments, the second mounting tails of the first group of power contacts are disposed between the first and second mounting tails of the second group of power contacts with respect to the lateral direction.

In some embodiments, the second mounting tails of the first group of power contacts are offset equidistantly between the first and second mounting tails of the second group of power contacts with respect to the lateral direction.

In some embodiments, the first mounting tails of the second group of power contacts are disposed between the first and second mounting tails of the first group of power contacts with respect to the lateral direction.

In some embodiments, the first mounting tails of the second group of power contacts are offset equidistantly between the first and second mounting tails of the first group of power contacts with respect to the lateral direction.

In some embodiments, the mating ends and the mounting ends of each of the first group of power contacts lie on a first plane that is defined by the lateral direction and the transverse direction.

In some embodiments, the mating ends and the mounting ends of each of the second group of power contacts lie on a second plane that is defined by the lateral direction and the transverse direction.

In some embodiments, the mounting end of each of the first group of power contacts includes first and second mounting tails.

In some embodiments, the second mounting tails of the first group of power contacts are disposed between the first and second mounting tails of the second group of power contacts with respect to the lateral direction.

In some embodiments, the second mounting tails of the first group of power contacts are offset equidistantly between the first and second mounting tails of the second group of power contacts with respect to the lateral direction.

In some embodiments, the first mounting tails of the second group of power contacts are disposed between the first and second mounting tails of the first group of power contacts with respect to the lateral direction.

In some embodiments, the first mounting tails of the second group of power contacts are offset equidistantly between the first and second mounting tails of the first group of power contacts with respect to the lateral direction.

In some embodiments, the mating end of each of the first group of power contacts extends from the body along the lateral direction, and the mounting end of each of the first group of power contacts extends from the body along the transverse direction.

In some embodiments, the second mounting tails of the first group of power contacts are disposed between the first and second mounting tails of the second group of power contacts with respect to the transverse direction.

In some embodiments, the second mounting tails of the first group of power contacts are offset equidistantly between the first and second mounting tails of the second group of power contacts with respect to the transverse direction.

In some embodiments, the first mounting tails of the second group of power contacts are disposed between the first and second mounting tails of the first group of power contacts with respect to the transverse direction.

In some embodiments, the first mounting tails of the second group of power contacts are offset equidistantly between the first and second mounting tails of the first group of power contacts with respect to the transverse direction.

In some embodiments, the mating ends and the mounting ends of each of the first and second groups of power contacts extend from the respective contact body along the lateral direction.

In some embodiments, the mating ends and the mounting ends of each of the second group of power contacts lie on a common plane that is defined by the lateral direction and the transverse direction.

In some embodiments, an electrical power assembly may comprise an electrical connector of the type described herein and and the first substrate.

In some embodiments, a method of assembling the electrical power assembly may comprise the step of inserting the first substrate into the slot so as to mate the at least six mating ends with the first common electrical contact pad of the first substrate.

In some embodiments, an electrical power connector may comprise an electrically insulative connector housing that defines a mating interface, wherein the mating interface further defines a slot, the connector housing further defining a mounting interface; a first plurality of electrical power contacts supported by the connector housing and arranged along a longitudinal direction, each of the first plurality of electrical power contacts defining a first mating end disposed proximate to the mating interface, a first mounting end that is opposite the mating end and disposed proximate to the mounting interface, and a first contact body that extends from the mating end to the mounting end; and a second plurality of electrical power contacts supported by the connector housing and electrically isolated from the first plurality of electrical power contacts and arranged along a longitudinal direction, each of the second plurality of electrical power contacts defining a second mating end disposed proximate to the mating interface, a second mounting end that is opposite the mating end and disposed proximate to the mounting interface, and a second contact body that extends from the mating end to the mounting end, wherein each of the first mating ends includes a first beam that extends from the first contact body, each of the second mating ends includes a second beam that extends from the second contact body, the first beam and the second beam are disposed at opposed sides of the slot with respect to a transverse direction that is perpendicular to the longitudinal direction, such that a first substrate is configured to be received between the first and second beams along a lateral direction that is perpendicular to each of the transverse direction and the longitudinal direction, wherein the electrical power contacts of the first plurality are spaced from each other along the longitudinal direction such that the first beams of at least six of the first plurality of electrical power contacts are configured to contact a first common electrical contact pad on a first side of the first substrate when the first substrate is received in the slot, and wherein the electrical power contacts of the second plurality are spaced from each other along the longitudinal direction such that the second beams of at least six of the second plurality of electrical power contacts are configured to contact a second common electrical contact pad on a second side of the first substrate opposite the first side when the first substrate is received in the slot.

In some embodiments, the first beams of the at least six of the first plurality of electrical power contacts are spaced equidistantly along the longitudinal direction.

In some embodiments, the first beams are aligned with each other along the longitudinal direction.

In some embodiments, one of the first beams of the at least six of the first plurality of electrical power contacts are aligned with respective ones of the second beams of the at least six of the first plurality of electrical power contacts along the transverse direction.

In some embodiments, the second beams are aligned with each other along the longitudinal direction.

In some embodiments, each of the mating ends of the at least six of the first plurality of electrical power contacts does not include any beams other than the first beam, and each of the mating ends of the at least six of the second plurality of electrical power contacts does not include any beams other than the second beam.

In some embodiments, the first beams of between six and sixteen of the first plurality of electrical power contacts are configured to contact the first common electrical contact pad when the substrate is received in the slot.

In some embodiments, the first beams of eight of the first plurality of electrical power contacts are configured to contact the first common electrical contact pad when the substrate is received in the slot.

In some embodiments, the first beams of ten of the first plurality of electrical power contacts are configured to contact the first common electrical contact pad when the substrate is received in the slot.

In some embodiments, the second beams of between six and sixteen of the second plurality of electrical power contacts are configured to contact the second common electrical contact pad when the substrate is received in the slot.

In some embodiments, the second beams of eight of the second plurality of electrical power contacts are configured to contact the second common electrical contact pad when the substrate is received in the slot.

In some embodiments, the second beams of ten of the second plurality of electrical power contacts are configured to contact the second common electrical contact pad when the substrate is received in the slot.

In some embodiments, the first beams of the at least six electrical power contacts are spaced from each other center-to-center along the longitudinal direction at a contact pitch that is between approximately 0.7 mm and approximately 2 mm.

In some embodiments, the contact pitch is approximately 1.27 mm.

In some embodiments, the second fingers of the at least six electrical power contacts are spaced center-to-center along the longitudinal direction at the contact pitch.

In some embodiments, a current density of approximately 48 amperes may flow over 10.16 mm along the first side of the substrate.

In some embodiments, a current density of approximately 48 amperes may flow over 10.16 mm along the first side of the substrate.

In some embodiments, the at least six of the first plurality of electrical power contacts comprise a first group of power contacts and a second group of power contacts, ones of the first group are alternatingly arranged with ones of the second group along the longitudinal direction, and the first group of power contacts has a different geometry than second group of power contacts, and the at least six of the second plurality of electrical power contacts comprise a first group of power contacts and a second group of power contacts, ones of the first group are alternatingly arranged with ones of the second group along the longitudinal direction, and the first group of power contacts has a different geometry than second group of power contacts.

In some embodiments, all of the electrical power contacts comprise the first and second groups of the first and second pluralities of power contacts, respectively, and ones of the first group are alternatingly arranged with ones of the second group along the longitudinal direction.

In some embodiments, the different geometry comprises a position of the mounting ends and a different number of mounting tails at the mounting ends.

In some embodiments, an entirety of the first groups of power contacts are spaced from all others of the power contacts along the longitudinal direction.

In some embodiments, the geometry comprises at least one of a number of mounting tails and a position of mounting tails along a respective plane that is defined by the lateral direction and the transverse direction.

In some embodiments, the mounting end of each the first groups of power contacts includes a single mounting tail that extends from the contact body, and the mounting ends of each of the second groups of power contacts includes more than one mounting tail that extend from the contact body.

In some embodiments, the single mounting tails of the first group of the first plurality of power contacts are aligned with each other along the longitudinal direction, and the single mounting tails of the first group of the second plurality of power contacts are aligned with each other along the longitudinal direction.

In some embodiments, the mounting end of each of the second group of the first plurality of power contacts includes first and second mounting tails that extend from the contact body and are spaced from each other along the respective plane, and the mounting ends of each of the second group of the second plurality of power contacts includes first and second mounting tails that extend from the contact body and are spaced from each other along the respective plane.

In some embodiments, the mounting end of each of the second group of the first plurality of power contacts includes no more than the first and second mounting tails, and the mounting end of each of the second group of the second plurality of power contacts includes no more than the first and second mounting tails.

In some embodiments, the first mounting tails of the second group of the first plurality of power contacts are aligned with each other along the longitudinal direction, the first mounting tails of the second group of the second plurality of power contacts are aligned with each other along the longitudinal direction, the second mounting tails of the second group of the first plurality of power contacts are aligned with each other along the longitudinal direction, and the second mounting tails of the second group of the second plurality of power contacts are aligned with each other along the longitudinal direction.

In some embodiments, the single mounting tail of each of the first group of the first plurality of power contacts is offset from each of the first mounting tails of all of the second group of the first plurality of power contacts a first distance along the respective plane, and is offset from each of the second mounting tails of all of the second group of the first plurality of power contacts a second distance along the respective plane that is different than the first distance, and the single mounting tail of each of the first group of the second plurality of power contacts is offset from each of the first mounting tails of all of the second group of the second plurality of power contacts a first distance along the respective plane, and is offset from each of the second mounting tails of all of the second group of the second plurality of power contacts a second distance along the respective plane that is different than the first distance.

In some embodiments, the single mounting tail of each of the first group of the first plurality of power contacts is disposed between the first mounting tails of all of the second group of the first plurality of power contacts and the second mounting tails of all of the second group of the first plurality of power contacts, and the single mounting tail of each of the first group of the second plurality of power contacts is disposed between the first mounting tails of all of the second group of the second plurality of power contacts and the second mounting tails of all of the second group of the second plurality of power contacts.

In some embodiments, the mating ends extend from the respective contact body along the lateral direction, and the mounting ends extend from the respective contact body along the transverse direction.

In some embodiments, the single mounting tail of each of the first group of the first plurality of power contacts is offset from each of the first mounting tails of all of the second group of the first plurality of power contacts a first distance along the lateral direction, and is offset from each of the second mounting tails of all of the second group of the first plurality of power contacts a second distance along the lateral direction, and the single mounting tail of each of the first group of the second plurality of power contacts is offset from each of the first mounting tails of all of the second group of the second plurality of power contacts a first distance along the lateral direction, and is offset from each of the second mounting tails of all of the second group of the second plurality of power contacts a second distance along the lateral direction.

In some embodiments, the single mounting tail of each of the first group of the first plurality of power contacts is disposed between the first mounting tails of all of the second group of the first plurality of power contacts and the second mounting tails of all of the second group of the first plurality of power contacts, and the single mounting tail of each of the first group of the second plurality of power contacts is disposed between the first mounting tails of all of the second group of the second plurality of power contacts and the second mounting tails of all of the second group of the second plurality of power contacts.

In some embodiments, the mating ends of the second group of power contacts are disposed closer to the first mounting tails than the second mounting tails along the lateral direction, and the single mounting tails are disposed closer to the second mounting tails than the first mounting tails with respect to the lateral direction.

In some embodiments, the mounting ends of each of the first plurality of power contacts of the first group are out of plane with each of the first and second beams with respect to a respective plane that is defined by the transverse direction and the lateral direction, and the mounting ends of each of the second plurality of power contacts of the first group are out of plane with each of the first and second beams with respect to a respective plane that is defined by the transverse direction and the lateral direction.

In some embodiments, the contact body of each of the first plurality of power contacts of the first group includes a first section and a second section that is jogged along the longitudinal direction with respect to the first section, and the contact body of each of the second plurality of power contacts of the first group includes a first section and a second section that is jogged along the longitudinal direction with respect to the first section.

In some embodiments, the second distance is different than the first distance.

In some embodiments, the mounting end of each of the first group of the first plurality of power contacts includes only the single mounting tail and no other mounting tails, and the mounting end of each of the first group of the second plurality of power contacts includes only the single mounting tail and no other mounting tails.

In some embodiments, the mounting end of each of the first group of the first plurality of power contacts includes first and second mounting tails, and the mounting end of each of the first group of the second plurality of power contacts includes first and second mounting tails.

In some embodiments, the second mounting tails of the first group of the first plurality of power contacts are disposed between the first and second mounting tails of the second group of the first plurality of power contacts with respect to the lateral direction, and the second mounting tails of the first group of the second plurality of power contacts are disposed between the first and second mounting tails of the second group of the second plurality of power contacts with respect to the lateral direction.

In some embodiments, the second mounting tails of the first group of the first plurality of power contacts are offset equidistantly between the first and second mounting tails of the second group of the first plurality of power contacts with respect to the lateral direction, and the second mounting tails of the first group of the second plurality of power contacts are offset equidistantly between the first and second mounting tails of the second group of the second plurality of power contacts with respect to the lateral direction.

In some embodiments, the first mounting tails of the second group of the first plurality of power contacts are disposed between the first and second mounting tails of the first group of the first plurality of power contacts with respect to the lateral direction, and the first mounting tails of the second group of the second plurality of power contacts are disposed between the first and second mounting tails of the first group of the second plurality of power contacts with respect to the lateral direction.

In some embodiments, the first mounting tails of the second group of the first plurality of power contacts are offset equidistantly between the first and second mounting tails of the first group of the first plurality of power contacts with respect to the lateral direction, and the first mounting tails of the second group of the second plurality of power contacts are offset equidistantly between the first and second mounting tails of the first group of the second plurality of power contacts with respect to the lateral direction.

In some embodiments, the mating ends and the mounting ends of each of the first group of the first plurality of power contacts lie on a respective first plane that is defined by the lateral direction and the transverse direction, and the mating ends and the mounting ends of each of the first group of the second plurality of power contacts lie on a respective first plane that is defined by the lateral direction and the transverse direction.

In some embodiments, the mating ends and the mounting ends of each of the second group of the first plurality of power contacts lie on a respective second plane that is defined by the lateral direction and the transverse direction, and the mating ends and the mounting ends of each of the second group of the second plurality of power contacts lie on a respective second plane that is defined by the lateral direction and the transverse direction, In some embodiments, the mounting end of each of the first group of first plurality of power contacts includes first and second mounting tails, and the mounting end of each of the first group of second plurality of power contacts includes first and second mounting tails.

In some embodiments, the second mounting tails of the first group of the first plurality of power contacts are disposed between the first and second mounting tails of the second group of the first plurality of power contacts with respect to the lateral direction, and the second mounting tails of the first group of the second plurality of power contacts are disposed between the first and second mounting tails of the second group of the second plurality of power contacts with respect to the lateral direction.

In some embodiments, the second mounting tails of the first group of the first plurality of power contacts are offset equidistantly between the first and second mounting tails of the second group of the first plurality of power contacts with respect to the lateral direction, and the second mounting tails of the first group of the second plurality of power contacts are offset equidistantly between the first and second mounting tails of the second group of the second plurality of power contacts with respect to the lateral direction.

In some embodiments, the first mounting tails of the second group of the first plurality of power contacts are disposed between the first and second mounting tails of the first group of the first plurality of power contacts with respect to the lateral direction, and the first mounting tails of the second group of the second plurality of power contacts are disposed between the first and second mounting tails of the first group of the second plurality of power contacts with respect to the lateral direction.

In some embodiments, the first mounting tails of the second group of the first plurality of power contacts are offset equidistantly between the first and second mounting tails of the first group of the first plurality of power contacts with respect to the lateral direction, and the first mounting tails of the second group of the second plurality of power contacts are offset equidistantly between the first and second mounting tails of the first group of the second plurality of power contacts with respect to the lateral direction.

In some embodiments, the mating end of each of the first group of the first plurality of power contacts extends from the body along the lateral direction, and the mounting end of each of the first group of the first plurality of power contacts extends from the body along the transverse direction, the mating end of each of the first group of the second plurality of power contacts extends from the body along the lateral direction, and the mounting end of each of the first group of the second plurality of power contacts extends from the body along the transverse direction.

In some embodiments, the second mounting tails of the first group of the first plurality of power contacts are disposed between the first and second mounting tails of the second group of the first plurality of power contacts with respect to the transverse direction, and the second mounting tails of the first group of the second plurality of power contacts are disposed between the first and second mounting tails of the second group of the second plurality of power contacts with respect to the transverse direction.

In some embodiments, the second mounting tails of the first group of the first plurality of power contacts are offset equidistantly between the first and second mounting tails of the second group of the first plurality of power contacts with respect to the transverse direction, and the second mounting tails of the first group of the second plurality of power contacts are offset equidistantly between the first and second mounting tails of the second group of the second plurality of power contacts with respect to the transverse direction.

In some embodiments, the first mounting tails of the second group of the first plurality of power contacts are disposed between the first and second mounting tails of the first group of the first plurality of power contacts with respect to the transverse direction and the first mounting tails of the second group of the second plurality of power contacts are disposed between the first and second mounting tails of the first group of the second plurality of power contacts with respect to the transverse direction.

In some embodiments, the first mounting tails of the second group of the first plurality of power contacts are offset equidistantly between the first and second mounting tails of the first group of the first plurality of power contacts with respect to the transverse direction, and the first mounting tails of the second group of the second plurality of power contacts are offset equidistantly between the first and second mounting tails of the first group of the second plurality of power contacts with respect to the transverse direction.

In some embodiments, the mating ends and the mounting ends of each of the first and second groups of the first plurality of power contacts extend from the respective contact body along the lateral direction, and the mating ends and the mounting ends of each of the first and second groups of the second plurality of power contacts extend from the respective contact body along the lateral direction.

In some embodiments, the mating ends and the mounting ends of each of the second group of the first plurality of power contacts lie on a common plane that is defined by the lateral direction and the transverse direction, and the mating ends and the mounting ends of each of the second group of the second plurality of power contacts lie on a common plane that is defined by the lateral direction and the transverse direction.

In some embodiments, an electrical power assembly may comprise an electrical connector of the type described herein and the first substrate.

In some embodiments, a method of assembling the electrical power assembly may comprise the step of inserting the first substrate into the slot so as to 1) mate the at least six mating ends of the first plurality of electrical contacts with the first common electrical contact pad on the first side of the first substrate, and 2) mate the at least six mating ends of the second plurality of electrical contacts with the second common electrical contact pad on the second side of the first substrate.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Furthermore, it should be appreciated that structures ad features described above in connection with one or more embodiments can be included in all other embodiments, unless otherwise indicated. Those skilled in the relevant art, having the benefit of the teachings of this specification, may effect numerous modifications to the invention as described herein, and changes may be made without departing from the scope and spirit of the invention as defined by the appended claims.

The invention claimed is:

1. An electrical interconnection system comprising:

an electrically insulative connector housing; and a plurality of electrical power contacts supported by the connector housing and spaced along a longitudinal direction, each of the electrical power contacts comprises a mating end, wherein each of the mating ends comprises a first beam and an opposing second beam, wherein the first beams and the second beams of the plurality of electrical power contacts are aligned with respect to a transverse direction that is perpendicular to the longitudinal direction so as to define opposed sides of a slot, such that when a member is inserted in the slot along a lateral direction that is perpendicular to each of the transverse direction and the longitudinal direction, the first beam electrically contacts a first conductive surface of the member and the second beam electrically contacts a second conductive surface of the member, and wherein at least six corresponding first beams are configured to electrically contact the first conductive surface in a continuous region and at least six corresponding second beams are configured to electrically contact the second conductive surface in a continuous region.

2. The electrical interconnection system as recited in claim 1, wherein each of the plurality of electrical power contacts comprises a planar body in a plane with the first beam and the second beam extending from the body in the plane.

3. The electrical interconnection system as recited in claim 2, wherein the planar body portions of the plurality of electrical power contacts are disposed in parallel planes.

4. The electrical interconnection system as recited in claim 3, wherein each of the plurality of electrical power contacts comprises a mounting end extending from the respective body in the plane of the body opposite the first beam and the second beam.

5. The electrical interconnection system as recited in claim 3, wherein the plurality of electrical power contacts are configured to carry power of one circuit such that multiple points of contact on the circuit are formed.

6. The electrical interconnection system as recited in claim 1, wherein the member defines a plane extending along the longitudinal direction and the lateral direction.

7. The electrical interconnection system as recited in claim 1, wherein the plurality of electrical power contacts are spaced, along the longitudinal direction, by a distance that is between approximately 0.7 mm and approximately 2 mm.

8. The electrical interconnection system as recited in claim 1, wherein the electrical interconnection system is configured to carry 96 amperes of electrical current at less than or equal to a 30 degree Celsius temperature rise.

9. The electrical interconnection system as recited in claim 1, wherein the plurality of electrical power contacts are spaced equidistantly along the longitudinal direction.

10. The electrical interconnection system as recited in claim 1, wherein the first beam has a width that is between approximately 0.3 mm and approximately 0.7 mm.

11. The electrical interconnection system as recited in claim 1, wherein the first beam has a length that is between approximately 2 mm and approximately 4 mm.

12. The electrical interconnection system as recited in claim 1, wherein a ratio between a length of the first beam and a width of the first beam is between 0.3 and 0.55.

13. The electrical interconnection system as recited in claim 1, wherein, when the electrical power contacts contact the member, the electrical power contacts have a resistance of between approximately 0.02 milliohm and 0.025 milliohm.

14. The electrical interconnection system as recited in claim 1, wherein the first conductive region has a width, along the longitudinal direction, that is between 8 mm and 12 mm.

15. The electrical interconnection system as recited in claim 1, wherein the first and second beams are flexible along the transverse direction.

16. An electrical interconnection system comprising:

a first component configured for making a separable power connection to a second component comprising a first member having a first surface and a second surface opposite the first surface, the first surface having a first continuous conductive region and the second surface having a second continuous conductive region, wherein the first component comprises:

a connector housing; and a plurality of planar conductive members supported by the connector housing and disposed side-by-side along a longitudinal direction, each of the plurality of planar conductive members comprising a planar body disposed in a plane and a mating end extending from the body in the plane, wherein the planes of the plurality of planar conductive members are parallel, and wherein each of the mating ends comprises a first beam and a second beam spaced from the first beam along a transverse direction that is perpendicular to the longitudinal direction, wherein the plurality of planar conductive members are configured such that, when the member is inserted between the first beams and the second beams of the planar conductive members, for at least six adjacent ones of the planar conductive members, the first beams electrically contact the first continuous conductive region and the second beams electrically contact the second continuous conductive region, and wherein the at least six planar conductive members are configured to carry power of one circuit in order to form multiple points of contact to a common power circuit.

17. The electrical interconnection system as recited in claim 16, wherein the planar conductive members are spaced, along the longitudinal direction, by a distance that is between approximately 0.7 mm and approximately 2 mm.

18. The electrical interconnection system as recited in claim 16, wherein the electrical interconnection system is configured to carry 96 amperes of electrical current at less than or equal to a 30 degree Celsius temperature rise through the at least six adjacent ones of the plurality of planar conductive members.

19. The electrical interconnection system as recited in claim 16, wherein the plurality of planar conductive members are spaced equidistantly along the longitudinal direction.

20. The electrical interconnection system as recited in claim 16, wherein each of the plurality of planar conductive members is configured to form a contact resistance with the member between approximately 0.02 milliohm and 0.025 milliohm.

21. The electrical interconnection system as recited in claim 16, wherein the first conductive region has a width, along the longitudinal direction, that is between 8 mm and 12 mm.

22. The electrical interconnection system as recited in claim 16, wherein the first and second beams are flexible along the transverse direction.

23. The electrical interconnection system as recited in claim 16, wherein each of the plurality of planar conductive members comprises a mounting end extending from the respective body in the plane of the body opposite the first beam and the second beam.

24. A method of operating an electrical interconnection system comprising:

making a power connection by mating a first component to a second component, wherein:

the second component comprises a first member having a first surface and a second surface opposite the first surface the first surface having a first continuous conductive region and the second surface having a second continuous conductive region, and the first component comprises:

a connector housing; and a plurality of planar conductive members supported by the connector housing and disposed side-by-side along a longitudinal direction, each of the plurality of planar conductive members comprising a planar body disposed in a plane and a mating end extending from the body in the plane, wherein the planes of the plurality of planar conductive members are parallel, and wherein each of the mating ends comprises a first beam and a second beam spaced from the first beam along a transverse direction that is perpendicular to the longitudinal direction, wherein the plurality of planar conductive members are configured such that, when the first member is inserted between the first beams and the second beams of the planar conductive members, the first beams electrically contact the first continuous conductive region and the second beams electrically contact the second continuous conductive region; and passing current through the power connection, wherein the current flows through the first continuous conductive region and the second continuous conductive region, through mating contact points between the mating ends of the at least six adjacent ones of the plurality of planar conductive members and the first continuous conductive region and the second continuous conductive region, and through bodies of the at least six of the plurality of planar conductive members.

25. The method of operating an electrical interconnection system as recited in claim 24, wherein the at least six of the plurality of planar conductive members are adjacent one another to provide a contact pitch between 0.7 mm and 2 mm.

* * * * *